US008877417B2

(12) United States Patent
Kaya et al.

(10) Patent No.: US 8,877,417 B2
(45) Date of Patent: Nov. 4, 2014

(54) TONER

(75) Inventors: Takaaki Kaya, Suntou-gun (JP); Kenji Aoki, Mishima (JP); Ayako Okamoto, Susono (JP); Atsushi Tani, Suntou-gun (JP); Takashige Kasuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/186,303

(22) Filed: Jul. 19, 2011

(65) Prior Publication Data

US 2012/0021348 A1 Jan. 26, 2012

(30) Foreign Application Priority Data

Jul. 22, 2010 (JP) ..... 2010-165308

(51) Int. Cl.
*G03G 9/087* (2006.01)
*G03G 9/08* (2006.01)

(52) U.S. Cl.
CPC ..... *G03G 9/08755* (2013.01); *G03G 9/08764* (2013.01); *G03G 9/08795* (2013.01); *G03G 9/08797* (2013.01); *G03G 9/0821* (2013.01); *G03G 9/08788* (2013.01)
USPC ..... 430/109.4

(58) Field of Classification Search
USPC ..... 430/109.4
See application file for complete search history.

(56) References Cited

U.S. PATENT DOCUMENTS

| | | | | |
|---|---|---|---|---|
| 2004/0132920 | A1 * | 7/2004 | Matsumura et al. | 525/418 |
| 2004/0229148 | A1 * | 11/2004 | Kadota et al. | 430/111.4 |
| 2004/0229149 | A1 * | 11/2004 | Kadota et al. | 430/111.4 |
| 2004/0229150 | A1 * | 11/2004 | Miyazaki et al. | 430/111.4 |
| 2004/0234878 | A1 * | 11/2004 | Miyazaki et al. | 430/108.1 |
| 2007/0048647 | A1 * | 3/2007 | Daimon et al. | 430/110.2 |
| 2007/0092823 | A1 * | 4/2007 | Matsumura et al. | 430/124 |
| 2008/0050669 | A1 * | 2/2008 | Ohmura et al. | 430/109.4 |
| 2011/0014564 | A1 * | 1/2011 | Moffat et al. | 430/137.11 |
| 2011/0065039 | A1 * | 3/2011 | Ota et al. | 430/109.3 |
| 2012/0021349 | A1 * | 1/2012 | Tani et al. | 430/109.4 |

FOREIGN PATENT DOCUMENTS

| | | | | |
|---|---|---|---|---|
| JP | 2004-191927 A | | 7/2004 | |
| JP | 2007-114635 A | | 5/2007 | |
| JP | 2008-052192 A | | 3/2008 | |
| WO | 2009122687 | * | 10/2009 | G03G 9/087 |

* cited by examiner

*Primary Examiner* — Hoa V Le
(74) *Attorney, Agent, or Firm* — Canon U.S.A., Inc. IP Division

(57) ABSTRACT

In a toner formed of toner particles which include a colorant, a wax, and a binder resin containing a crystalline resin (a) primarily composed of a polyester, the crystalline resin has an endothermic peak temperature (Tp) in a range of 50° C. to 80° C., and in a viscoelasticity measurement of the toner, G"(Tp−10) is in a range of $5.0\times10^7$ to $5.0\times10^8$ Pa, G"(Tp+10) is in a range of $5.0\times10^5$ to $5.0\times10^6$ Pa, and G"(Tp−20), G"(Tp−10), G"(Tp+10), and G"(Tp+30) satisfy specific relationships.

1 Claim, 3 Drawing Sheets

TONER

BACKGROUND OF THE INVENTION

1. Field of the Invention

The present invention relates to a toner used for a recording method, such as an electrophotographic method, an electrostatic recording method, and a toner jet type recording method. In particular, the present invention relates to a toner used for a copying machine, a printer, or a facsimile, each of which forms a fixed image in such a way that a toner image formed on an electrostatic latent image carrier is transferred onto a transfer member and is then fixed under heat pressure conditions.

2. Description of the Related Art

In recent years, energy saving has been considered as a significant technical subject also in electrophotographic apparatuses, and a substantial reduction in heat quantity consumed for a fixing device has been discussed. Accordingly, a toner has been required to be fixed by lower energy.

Heretofore, in order to perform fixing at a lower temperature, a method which enables a binder resin to have a sharper melt property has been known as one of effective methods. From this point of view, a toner using a crystalline polyester resin has been introduced. Since molecular chains of a crystalline polyester resin are regularly aligned, the crystalline polyester resin has not a clear glass transition temperature and is not likely to be softened up to its crystalline melting point. Accordingly, attention has been paid to the crystalline polyester resin as a material which is able to satisfy heat-resistant storage stability and low-temperature fixability at the same time. However, although the crystalline polyester resin itself has a sharp melt property, the elasticity thereof at a high temperature is not enough, and there has been a problem in that high-temperature offset is liable to occur. Therefore, in general, the use of the crystalline polyester in combination with an amorphous polyester has been studied.

Japanese Patent Laid-Open No. 2004-191927 has disclosed that as a toner using a crystalline polyester for a binder resin, in a capsule type toner containing a crystalline polyester and an amorphous polymer, the storage elastic modulus and loss modulus at a temperature of its melting point +20° C. are controlled to improve the fixing latitude.

Japanese Patent Laid-Open No. 2007-114635 has disclosed that by using a block copolymer obtained by esterification of a crystalline polyester block and an amorphous polyester block, fixing can be performed by low-temperature heating.

Japanese Patent Laid-Open No. 2008-052192 has disclosed a toner having improved heat-resistant storage stability and high-temperature offset resistance by a urea-modified polyester formed by bonding a segment of a crystalline polyester and a segment of an amorphous polyester with an amino cross-linking agent.

However, it was found that since the toner disclosed in Japanese Patent Laid-Open No. 2004-191927 is used by mixing the crystalline polyester and the amorphous polymer, the elasticity at a high temperature is not sufficient, a decrease in glossiness is liable to occur due to infiltration of the toner into paper, and the temperature range for fixing is decreased by the high-temperature offset.

In addition, since the toners disclosed in Japanese Patent Laid-Open Nos. 2007-114635 and 2008-052192 each uses the block polymer formed by binding an amorphous polyester and a crystalline polyester, the viscosity at a high temperature can be adjusted by the amorphous polyester, and hence the high-temperature offset can be suppressed. However, in the toners described above, the content of the crystalline polyester in the total binder resin is low, and in addition since an endothermic peak derived from the crystalline polyester detected by a differential scanning calorimeter (DSC) measurement is considerably broad, it was found that the crystallinity thereof is low.

The reason for this is believed that since these toners are each formed through a heating step at the melting point or more of the crystalline polyester in a manufacturing process, the crystallinity thereof is degraded due to the thermal history described above. As a result, the intrinsic sharp melt effect of the crystalline polyester cannot be fully obtained, and the effect of low-temperature fixability is not enough.

As described above, even when these crystalline polyesters are used, it is difficult to obtain a toner having a wide fixing temperature region from a low temperature to a high temperature, and hence a toner having further improved properties has been desired.

SUMMARY OF THE INVENTION

In consideration of the above problems, aspects of the present invention provide a toner having a wide fixing range from a low to a high temperature and excellent heat-resistant storage stability. Furthermore, aspects of the present invention provide a toner capable of obtaining an image having high glossiness and high quality.

According to aspects of the present invention, there is provided a toner comprising toner particles, each of which comprises a colorant, a wax, and a binder resin, wherein the binder resin comprises a resin (a) mainly composed of a polyester unit. In the toner described above, the resin (a) is a crystalline resin, and in measuring endothermic amount of this toner by a differential scanning calorimeter, an endothermic peak temperature (Tp) derived from the binder resin is in a range of 50° C. to 80° C. Further, in measuring a viscoelasticity of this toner, when a loss modulus G"[Pa] at a temperature T[° C.] is represented by G"(T), G"(Tp−10) is in a range of $5.0\times10^7$ to $5.0\times10^8$ Pa, G"(Tp+10) is in a range of $5.0\times10^5$ to $5.0\times10^6$ Pa, and the loss modulus G"[Pa] satisfies the following formulas (1) to (3).

$$-0.10 \leq \mathrm{Log}\,[G''(Tp-20)]-\mathrm{Log}\,[G''(Tp-10)] \leq 0.50 \quad (1)$$

$$0.10 \leq \mathrm{Log}\,[G''(Tp+10)]-\mathrm{Log}\,[G''(Tp+30)] \leq 1.00 \quad (2)$$

$$\mathrm{Log}\,[G''(Tp-5)]-\mathrm{Log}\,[G''(Tp+5)] \geq 1.0 \quad (3)$$

According to aspects of the present invention, there is provided a toner which has excellent low-temperature fixability and which suppresses the generation of high-temperature offset. In addition, a toner having excellent heat-resistant storage stability can be obtained. Furthermore, a toner capable of forming an image having high glossiness and high quality can be obtained.

Further features of the present invention will become apparent from the following description of exemplary embodiments with reference to the attached drawings.

DESCRIPTION OF THE EMBODIMENTS

Hereinafter, a toner according to aspects of the present invention will be described with reference to preferable embodiments.

Through intensive research on the various problems of the toner using a crystalline polyester carried out by the present inventors, the present invention was finally made.

The toner according to aspects of the present invention includes at least a resin (a) as a binder resin composed of a polyester unit as a mainly component. In this embodiment, the "mainly component" indicates that the content of the polyester is 50 percent by mass or more of the total of the resin (a). In addition, according to aspects of the present invention, the resin (a) has a crystalline structure, and the maximum endothermic peak of the toner detected by a measurement using a differential scanning calorimeter (DSC) has features of a clear crystalline structure. In addition, the above crystalline structure is preferably formed of a crystalline polyester component.

In the measurement of the endothermic amount of the toner by a differential scanning calorimeter, an endothermic peak temperature (Tp) derived from the binder resin obtained in a first temperature rise step is in a range of 50° C. to 80° C. The peak temperature (Tp) can be controlled by changing the softening temperature of a crystalline polyester used for the toner according to aspects of the present invention. When the peak temperature (Tp) is set in a range of 50° C. to 80° C., a toner having sufficient heat-resistant storage stability and low-temperature fixability can be designed. The lower limit of the peak temperature is preferably 55° C. or more, and the upper limit thereof is preferably 70° C. or less.

Figure 3:
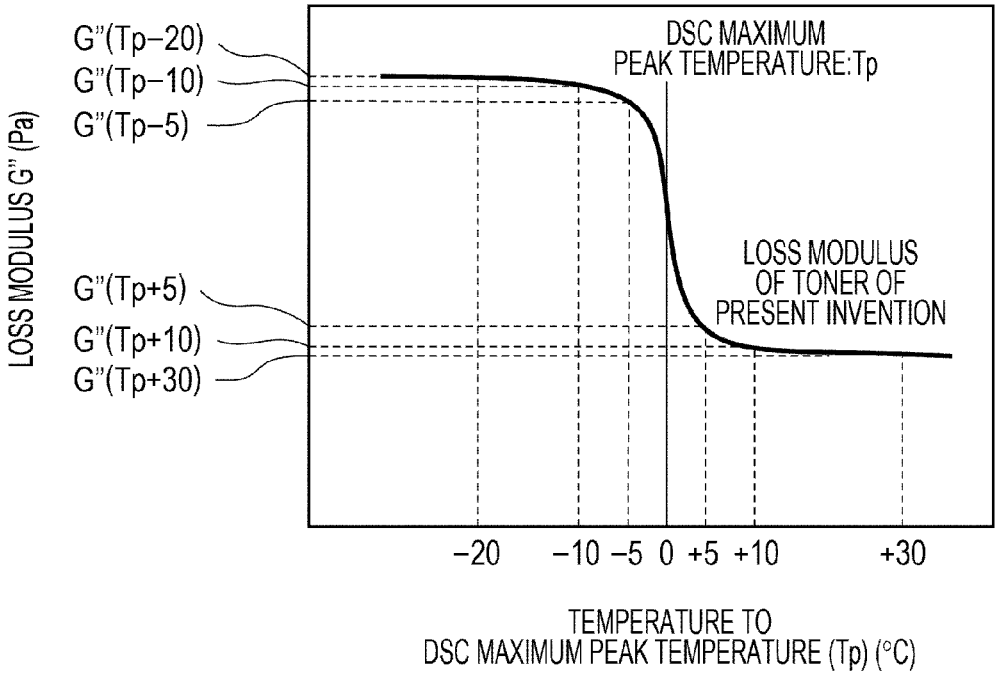
FIG. 3 is a graph showing the viscoelasticity of the toner according to aspects of the present invention.

A loss modulus G"(Tp−10) of the toner according to aspects of the present invention at a temperature Tp−10 (° C.) is in a range of $5.0\times10^7$ to $5.0\times10^8$ Pa. When the value of G"(Tp−10) is smaller than $5.0\times10^7$ Pa, decrease in heat-resistant storage stability and degradation of the toner under endurance conditions are liable to occur. On the other hand, when the value of G"(Tp−10) is larger than $5.0\times10^8$ Pa, the viscoelasticity of the toner is difficult to control, and as a result, a toner having a sharp melt property in a fixing temperature region cannot be designed. The value of G"(Tp−10) is preferably in a range of $7.0\times10^7$ to $3.0\times10^8$ Pa. In addition, one example of the curve of the loss modulus of the toner according to aspects of the present invention is shown in FIG. 3. As in the case of G"(Tp−10), a loss modulus G" at a temperature T[° C.] is represented by G"(T) [Pa].

In addition, a loss modulus G"(Tp+10) of the toner according to aspects of the present invention at a temperature 10° C. higher than the peak temperature (Tp) is in a range of $5.0\times10^5$ to $5.0\times10^6$ Pa. When the value of G"(Tp+10) is smaller than $5.0\times10^5$ Pa, the elasticity at a high temperature is not sufficient, and the high-temperature offset is liable to occur. On the other hand, when the value of G"(Tp+10) is larger than $5.0\times10^6$ Pa, even if the toner is fixed, decrease in glossiness of image and peeling thereof caused by folding are liable to occur. The value of G"(Tp+10) is more preferably in a range of $7.0\times10^5$ to $3.0\times10^6$ Pa.

Furthermore, the toner according to aspects of the present invention satisfies the following formulas (1) to (3) obtained by a viscoelasticity measurement.

$$-0.10 \leq \mathrm{Log}\,[G''(Tp-20)] - \mathrm{Log}\,[G''(Tp-10)] \leq 0.50 \quad (1)$$

$$0.10 \leq \mathrm{Log}\,[G''(Tp+10)] - \mathrm{Log}\,[G''(Tp+30)] \leq 1.00 \quad (2)$$

$$\mathrm{Log}\,[G''(Tp-5)] - \mathrm{Log}\,[G''(Tp+5)] \geq 1.0 \quad (3)$$

When the ratio of the crystalline polyester component in the resin (a) functioning as a binder resin is too low, the physical properties of the amorphous component becomes dominant, and the resin (a) becomes to have a glass transition temperature, and as a result, the formula (1) shows a value smaller than −0.10. In this case, since a sufficiently high glass transition temperature must be designed in order to satisfy the heat-resistant storage stability, the low-temperature fixing effect by the sharp melt property of the crystalline polyester is unlikely to be obtained. On the other hand, even in the case in which a relatively large amount of the crystalline polyester is contained in the resin (a), when the degree of crystallinity of the crystalline polyester is low, the formula (1) shows a value larger than 0.50. In this case, the change in loss modulus of the toner in a low-temperature region is large, and hence, sufficient heat-resistant storage stability cannot be obtained.

That is, a toner having both sufficient heat-resistant storage stability and low-temperature fixability can be obtained when the formula (1) is satisfied. The value of the formula (1) is more preferably in a range of 0.00 to 0.30.

In general, in the case in which a crystalline material and an amorphous material are used in combination, since these materials must be placed in a homogenous state by dissolution in an organic solvent or heating at a melting point or more of the crystalline material in a toner manufacturing process, these components dissolve in each other, and the crystalline structure cannot be maintained, thereby resulting in decrease of the degree of crystallinity.

According to aspects of the present invention, the value of the formula (1) cannot be easily achieved only by adjusting the ratio between the crystalline polyester component and the amorphous component in the resin (a) and can be achieved by a method of controlling the crystallinity of the crystalline polyester in a toner production. In particular, after toner particles are manufactured, as a treatment for increasing the degree of crystallinity, a heat treatment is performed at a temperature lower than the melting point of the crystalline polyester component. According to aspects of the present invention, hereinafter, this heat treatment is called an "annealing treatment".

In general, it has been known that the crystallinity of a crystalline resin is increased by performing an annealing treatment. The mechanism has been considered as follows. That is, it has been believed that when an annealing treatment is performed on a crystalline material, since the molecular movement of a polymer chain is increased to some extent by the heat, the polymer chain is reoriented to have a stabler structure, that is, a regular crystalline structure, and hence the crystallization occurs. When the treatment is performed at the melting point or more of a crystalline material, the polymer chain obtains energy higher than that necessary for reorientation thereof, and hence no recrystallization occurs.

Therefore, in order to activate the molecular movement of the crystalline polyester component in the toner as much as possible, it is important that the annealing treatment according to aspects of the present invention be performed in a limited temperature range with respect to the melting point of the crystalline polyester component.

The above formula (2) shows the amount of change in loss modulus in a high temperature region.

Since the change in viscosity to the change in temperature is small when the value of the formula (2) is smaller than 0.10, the viscosity cannot be sufficiently decreased in fixing, and as a result, an image obtained thereby tends to have insufficient glossiness. On the other hand, since the change in viscosity to the change in temperature is large when the value of the formula (2) is larger than 1.00, the high-temperature offset is liable to occur, and since the viscosity is also liable to be influenced by temperature variation of a fixing device, variation in glossiness of the image is liable to occur.

That is, when the formula (2) is satisfied, the generation of high-temperature offset can be suppressed, and a toner capable of exhibiting preferable glossiness can be obtained. The value of the formula (2) is preferably in a range of 0.20 to 0.80.

In order to satisfy the formula (2), the resin (a) used for the toner according to aspects of the present invention is preferably a copolymer in which at least one segment capable of forming a crystalline structure and at least one segment not forming a crystalline structure are chemically boned to each other. As the copolymer described above, although a block polymer, a graft polymer, and a star polymer may be mentioned by way of example, according to aspects of the present invention, a block polymer is preferably used.

The block polymer in this embodiment is a polymer in which in one molecule, polymers are bonded to each other with at least one covalent bond. The segments capable of forming a crystalline structure are regularly oriented to show the crystallinity when many thereof are gathered together, and hence the segments each indicates a crystalline polymer chain. On the other hand, even when being gathered together, the segments not forming a crystalline structure are not regularly oriented and form a random structure, and hence the segments each indicates an amorphous polymer chain.

When the crystalline polyester is represented by "A" and the amorphous polymer is represented by "B", the he block polymer described above may be any one of an AB type diblock polymer, an ABA type triblock polymer, a BAB type triblock polymer, and an ABAB . . . type multiblock polymer.

According to aspects of the present invention, the value of the formula (2) can be obtained by controlling the content of the amorphous component in the resin (a) and the viscoelasticity of the amorphous component.

In particular, there is effectively used a method for increasing the content of the amorphous component in the resin (a) by adjusting the ratio between the segment capable of forming a crystalline structure and the segment not forming a crystalline structure of the block polymer.

As the bond form of the segment capable of forming a crystalline structure and the segment not forming a crystalline structure of the block polymer, although an ester bond, a urea bond, and a urethane bond may be mentioned by way of example, in order to control the viscoelasticity of the amorphous component and, in particular, to increase the viscosity at a high temperature, a block polymer bonded with a urethane bond is particularly effectively used.

Furthermore, the toner according to aspects of the present invention satisfies the formula (3).

When the value of the formula (3) is smaller than 1.0, the sharp melt property of the crystalline component is not likely to be obtained, and the fixability at a low-temperature is degraded.

In a gel permeation chromatography (GPC) measurement of a THF soluble component, the toner according to aspects of the present invention is preferably has a number average molecular weight (Mn) in a range of 8,000 to 30,000 and a weight average molecular weight (Mw) in a range of 15,000 to 60,000. When the above molecular weights are in the respective ranges described above, a preferable viscoelasticity can be imparted to the toner. When Mn is smaller than 8,000, and Mw is smaller than 15,000, the toner is too softened, and the heat-resistant storage stability for a long period of time is liable to be degraded. When Mn is larger than 30,000, and Mw is larger than 60,000, the toner is too hardened, the fixability is degraded, and sufficient glossiness of image is not likely to be obtained; hence, the molecular weights mentioned above are not preferable. In addition, when the fixability at a low-temperature is not enough, the toner is liable to be peeled off from a fixed image. Mn is more preferably in a range of 10,000 to 25,000, and Mw is more preferably in a range of 25,000 to 50,000. Furthermore, Mw/Mn is preferably 6 or less. Mw/Mn is more preferably 3 or less.

Hereinafter, the segment capable of forming a crystalline structure of the block polymer will be described.

A preferable component which forms the segment capable of forming a crystalline structure is a crystalline polyester. For the crystalline polyester, an aliphatic diol having 4 to 20 carbon atoms and a polyvalent carboxylic acid are preferably used as raw materials.

Furthermore, the aliphatic diol preferably has a straight chain. Since the diol has a straight chain, the crystallinity of a toner can be easily increased, and the toner according to aspects of the present invention can be easily formed.

As aliphatic diols usable in aspects of the present invention, for example, although the following may be mentioned, the diols are not limited thereto. The following diols may be used in combination depending on the case. There may be mentioned, for example, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among those mentioned above, in view of the melting point, 1,4-butanediol, 1,5-pentanediol, and 1,6-hexanediol are more preferable.

In addition, an aliphatic diol having a double bond may also be used. As the aliphatic diol having a double bond, for example, the following may be mentioned. That is, for example, 2-butene-1,4-diol, 3-hexene-1,6-diol, and 4-octene-1,8-diol may be mentioned.

Next, the acid component used for preparation of the crystalline polyester will be described. The acid component used for preparation of the crystalline polyester is preferably a polyvalent carboxylic acid. As the polyvalent carboxylic acid, although an aromatic dicarboxylic acid and an aliphatic dicarboxylic acid are preferably used, an aliphatic dicarboxylic acid is preferable among those mentioned above, and in view of the crystallinity, a dicarboxylic acid having a straight chain is particularly preferable.

As the aliphatic dicarboxylic acid, for example, although the following may be mentioned, the dicarboxylic acid is not limited thereto. The dicarboxylic acids may be used in combination depending on the case. For example, there may be mentioned oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecane dicarboxylic acid, 1,16-hexadecanedicarboxylic acid, and 1,18-octadecanedicarboxylic acid. In addition, a lower alkyl ester and an acid anhydride may also be used. Among those mentioned above, sebacic acid, adipic acid, 1,10-decanedicarboxylic acid, and its lower alkyl ester and acid anhydride are preferably used.

As the aromatic dicarboxylic acid, for example, the following may be mentioned. That is, for example, terephthalic acid, isophthalic acid, 2,6-naphthalenedicarboxylic acid, and 4,4'-biphenyldicarboxylic acid may be mentioned.

Among those mentioned above, terephthalic acid is preferable since being easily available and easily formed into a polymer having a low melting point.

A dicarboxylic acid having a double bond may also be used. Since being able to cure the entire resin by using its own double bond, the dicarboxylic acid having a double bond is preferably used in order to prevent the high-temperature offset in fixing. As the dicarboxylic acid described above, for example, although fumaric acid, maleic acid, 3-hexenedioic acid, and 3-octenedioic acid may be mentioned, the above dicarboxylic acid is not limited thereto. In addition, lower alkyl esters and acid anhydrides of the above compounds may also be mentioned. Among those mentioned above, fumaric acid and maleic acid are preferable in view of cost.

A method for manufacturing the crystalline polyester is not particularly limited, and manufacturing can be performed by a general polyester polymerization method in which an acid component and an alcohol component are allowed to react with each other. In addition, depending on the types of monomers, a direct polycondensation method or an ester exchange method may be appropriately selected.

The crystalline polyester is preferably manufactured at a polymerization temperature in a range of 180° C. to 230° C., and in a reduced pressure atmosphere, if needed, a reaction is preferably performed while water and an alcohol generated by condensation are removed. When monomers are not dissolved nor fused together at a reaction temperature, dissolution is preferably promoted by adding a high melting point solvent as a solubilizing agent. The polycondensation reaction is performed while the solubilizing agent is removed by distillation. When a monomer having poor compatibility is used for a copolymerization reaction, it is preferably performed such that this monomer having poor compatibility and an acid or an alcohol to be polycondensed therewith is condensed in advance, and this condensed product is then polycondensed with a main component.

As a catalyst usable for manufacturing the crystalline polyester, for example, the following may be mentioned. As a titanium catalyst, for example, titanium tetraethoxide, titanium tetrapropoxide, titanium tetraisopropoxide, and titanium tetrabutoxide may be mentioned. As a tin catalyst, for example, there may be mentioned dibutyltin dichloride, dibutyltin oxide, and diphenyltin oxide.

The crystalline polyester preferably has an alcohol terminal for preparation of the above block polymer. Therefore, for the preparation of the crystalline polyester, the molar ratio of the alcohol component and the acid component (alcohol component/carboxylic acid component) is preferably in a range of 1.02 to 1.20.

The resin (a) according to aspects of the present invention contains an amorphous component functioning as the segment not forming a crystalline structure in the block polymer.

As the resin forming an amorphous component, any amorphous resin may be used. A known amorphous binder resin for toners may be used without any modification. However, the glass transition temperature of the resin forming an amorphous component is preferably in a range of 50° C. to 130° C. The glass transition temperature is more preferably in a range of 70° C. to 130° C. When the glass transition temperature is in the above range, the elasticity in a fixing temperature region can be easily maintained.

As the resin forming an amorphous component, for example, there may be mentioned a polyurethane resin, a polyester resin, a styrene acrylic resin, a polystyrene, and a styrene butadiene resin. In addition, those resins may be modified with urethane, urea, epoxy, or the like. In particular, among those mentioned above, in order to maintain the elasticity, a polyester resin and a polyurethane resin are preferably used.

As monomers used for the polyester resin as an amorphous component, for example, monomer components disclosed in Kobunshi Data Handbook, Kiso-Hen (Polymer Data Handbook, Fundamental Edition), edited by Kobunshi Gakkai (Society of Polymer Science), Baifukan Co., Ltd., such as a known divalent or more carboxylic acid and a known divalent or more alcohol, may be mentioned. As particular examples of these monomer components, for example, the following may be mentioned. As the divalent carboxylic acid, for example, there may be mentioned dibasic acids, such as succinic acid, adipic acid, sebacic acid, phthalic acid, isophthalic acid, terephthalic acid, malonic acid, and dodecenyl succinic acid; anhydrides and lower alkyl esters of the above compounds; and aliphatic unsaturated dicarboxylic acids, such as maleic acid, fumaric acid, itaconic acid, and citraconic acid. As the trivalent or more carboxylic acid, for example, there may be mentioned 1,2,4-benzenetricarboxylic acid, 1,2,5-benzene tricarboxylic acid, and anhydrides and lower alkyl esters of the above compounds. These compounds may be used alone, or at least two thereof may be used in combination.

As the divalent alcohol, for example, the following may be mentioned. That is, for example, bisphenol A, hydrogenated bisphenol A, an ethylene oxide or (and) a propylene oxide adduct of bisphenol A, 1,4-cyclohexanediol, 1,4-cyclohexane dimethanol, ethylene glycol, and propylene glycol may be mentioned. As the trivalent of more alcohol, for example, the following may be mentioned. That is, glycerol, trimethylolethane, trimethylolpropane, and pentaerythritol may be mentioned by way of example. These compounds may be used alone, or at least two thereof may be used in combination. In addition, if needed, a monovalent acid, such as acetic acid or benzoic acid, and a monovalent alcohol, such as cyclohexanol or benzyl alcohol, may also be used in order to adjust the acid number and the hydroxyl value.

The polyester resin may be synthesized using monomers in combination arbitrarily selected from the above monomer components by a known method disclosed, for example, in Jushukugo (Polycondensation) (Kagaku-Dojin Publishing Company, Inc.), Kobunshi Jikkengaku (High Polymer Experiment) (Jushukugo to Jufuka (Polycondensation and polyaddition), Kyoritsu Shuppan CO., LTD), or Poriesuteru Jushi Handobukku (Polyester Resin Handbook), (edited by The Nikkan Kogyo Shimbun Ltd.). For example, an ester exchange method and a direct polycondensation method may be used alone or in combination.

The polyurethane resin functioning as an amorphous component will be described. The polyurethane resin is a reactant of a diol and a substance containing a diisocyanate group, and by adjusting the diol and the diisocyanate, a resin having various functions can be obtained.

The following may be mentioned as the diisocyanate component.

For example, there may be mentioned an aromatic diisocyanate having 6 to 20 carbon atoms (carbon in an NCO group is excluded, and this is the same as those described later); an aliphatic diisocyanate having 2 to 18 carbon atoms; an alicyclic diisocyanate having 4 to 15 carbon atoms; an aromatic hydrocarbon diisocyanate having 8 to 15 carbon atoms; modified diisocyanate thereof (modified substances having a urethane group, a carbodiimide group, an allophanate group, a urea group, a biuret group, a urethodione group, a urethoimine group, an isocyanurate group, and an oxazolidone group, hereinafter also referred to as "modified diisocyanate"); and a mixture of at least two of those mentioned above.

The following may be mentioned as the aliphatic diisocyanate. For example, ethylene diisocyanate, tetramethylene diisocyanate, hexamethylene diisocyanate (HDI), and dodecamethylene diisocyanate may be mentioned.

The following may be mentioned as the alicyclic diisocyanate. For example, isophorone diisocyanate (IPDI), dicyclohexylmethane-4,4'-diisocyanate, cyclohexylene diisocyanate, and methyl cyclohexylene diisocyanate may be mentioned.

As the aromatic hydrocarbon diisocyanate, for example, the following may be mentioned. For example, m- and/or p-xylylene diisocyanate (XDI), α, α, α', α'-tetramethylxylylene diisocyanate may be mentioned.

Among these compounds mentioned above, an aromatic diisocyanate having 6 to 15 carbon atoms, an aliphatic diisocyanate having 4 to 12 carbon atoms, and an alicyclic diisocyanate having 4 to 15 carbon atoms are preferable, and HDI, IPDI, and XDI are particularly preferable.

Besides the above diisocyanate components, the polyurethane resin may also use a isocyanate compound having at least three functional groups.

In addition, for example, the following compounds may be mentioned as the diol component which can be used for the urethane resin. For example, an alkylene glycol (ethylene glycol, 1,2-propylene glycol, or 1,3-propylene glycol), an alkylene ether glycol (polyethylene glycol or polypropylene glycol), an alicyclic diol (1,4-cyclohexane dimethanol), a bisphenol compound (bisphenol A), and an alkylene oxide (ethylene oxide or propylene oxide) adduct of the above alicyclic diol may be mentioned.

An alkyl portion of the alkylene ether glycol may be a straight or a branched chain. According to aspects of the present invention, an alkylene glycol having a branched structure may also be preferably used.

According to aspects of the present invention, as a method for preparing the block polymer, a method in which after a unit forming a crystal portion and a unit forming an amorphous portion are separately prepared, these two types of units are chemically bonded to each other (two stage method) or a method in which raw materials for a unit forming a crystal portion and a unit forming an amorphous portion are simultaneously charged to prepare the block polymer in one step (one stage method) may be used.

As the block polymer according to aspects of the present invention, a block polymer may be formed by selecting an appropriate method among various methods in consideration of the reactivity of each terminal functional group. When polyesters resins are bonded to each other, although a binding agent may be used, a condensation reaction can be performed under heating and reduced-pressure conditions without using a binding agent. In particular, when one type of polyester has a high acid value, and the other type of polyester has a high hydroxyl value, the reaction proceeds smoothly. The reaction is preferably performed at a temperature of approximately 200° C.

When the binding agent is used, various binding agents may be used. A dehydration and an addition reaction can be performed, for example, by using a polyvalent carboxylic acid, a polyvalent alcohol, a polyvalent isocyanate, a polyfunctional epoxy, and/or a polyacid anhydride.

In addition, in the case of a block polymer having a crystalline portion of a polyester resin and an amorphous portion of a polyurethane resin, after the above units are separately prepared, the block polymer can be prepared by an urethane-forming reaction between an alcohol terminal of the crystalline polyester and an isocyanate terminal of the polyurethane. In addition, when a crystalline polyester having an alcohol terminal is mixed with a diol and a diisocyanate, which form a polyurethane, followed by heating, a block polymer can also be synthesized. In this case, at an early reaction stage at which the concentrations of the diol and the diisocyanate are high, these compounds selectively react with each other to form a polyurethane, and after the molecular weight thereof is increased to a certain extent, urethane formation occurs between the isocyanate terminal of the polyurethane and the alcohol terminal of the crystalline polyester.

In order to effectively obtain the advantage of the block polymer, a homopolymer of the crystalline polyester and a homopolymer of the amorphous polymer are preferably reduced in the toner as much as possible. That is, the block ratio is preferably high.

The resin (a) preferably contains 50 percent by mass or more of the unit forming a crystalline portion to the total of the resin (a). When the resin (a) is a block polymer, the composition ratio of the unit forming a crystalline portion in the block polymer is preferably 50 percent by mass or more. The sharp melt property can be easily obtained when the ratio of the unit forming a crystalline portion is 50 percent by mass or more. The composition ratio is more preferably 60 percent by mass or more.

On the other hand, the ratio of the unit forming an amorphous portion is preferably 10 percent by mass or more to the resin (a). The maintenance of the elasticity after the sharp melt is improved when the content of the unit forming an amorphous portion is 10 percent by mass or more. The content is more preferably 15 percent by mass or more.

That is, the ratio of the unit forming a crystalline portion to the resin (a) is preferably in a range of 50 to 90 percent by mass and is more preferably in a range of 60 to 85 percent by mass.

As the binder resin according to aspects of the present invention, besides the above resin (a), other common resins known as a binder resin for toners may also be contained. In this case, the content is not particularly limited. The content of the resin (a) in the binder resin is preferably 70 percent by mass or more and is more preferably 85 percent by mass or more.

As a wax used in aspects of the present invention, for example, the following may be mentioned.

For example, there may be mentioned aliphatic hydrocarbon waxes, such as a low molecular weight polyethylene, a low molecular weight polypropylene, a low molecular weight olefin copolymer, a microcrystalline wax, a paraffin wax, and a Fischer-Tropsch wax; oxides of aliphatic hydrocarbon waxes, such as an oxidized polyethylene wax; waxes primarily composed of a fatty acid ester, such as an aliphatic hydrocarbon ester wax; a partially or an entirely deoxidized fatty acid ester, such as a deoxidized carnauba wax; a partially esterified compound of a polyvalent alcohol and fatty acid, such as a behenic acid monoglyceride; and a methyl ester compound having a hydroxyl group obtained by hydrogenating a vegetable fat and oil.

As a particularly preferable wax used in aspects of the present invention, in a dissolution suspension method, an aliphatic hydrocarbon wax and an aliphatic hydrocarbon ester wax are preferable in terms of easy formation of wax dispersion liquid, easy infiltration into a formed toner, an exuding property from the toner in fixing, and a mold releasing property.

According to aspects of the present invention, the ester wax may have at least one ester bond in one molecule, and any one of a natural ester wax and a synthetic ester wax may be arbitrarily used.

As the synthetic ester wax, for example, a monoester wax synthesized from a long straight chain saturated fatty acid and a long straight chain saturated alcohol may be mentioned. The long straight chain saturated fatty acid is represented by the general formula of $C_nH_{2n+1}COOH$, and a compound having an integer n in a range of 5 to 28 is preferably used. The long straight chain saturated alcohol is represented by the general formula of $C_nH_{2n+1}OH$, and a compound having an integer n in a range of 5 to 28 is preferably used.

In addition, as the natural ester wax, for example, a candelilla wax, a carnauba wax, a rice wax, and derivatives thereof may be mentioned.

As a more preferably wax among those mentioned above, a synthetic ester wax formed from a long straight chain saturated fatty acid and a long straight chain saturated aliphatic alcohol or a natural wax containing at least one of the esters mentioned above as a main component may be mentioned.

Furthermore, according to aspects of the present invention, the ester is more preferably a monoester as well as the above straight chain structure.

According to aspects of the present invention, a hydrocarbon wax is also preferably used.

According to aspects of the present invention, with respect to 100 parts by mass of the binder resin, the content of the wax in the toner is preferably in a range of 2 to 20 parts by mass and more preferably in a range of 2 to 15 parts by mass. When the content is in the range described above, the mold releasing property and the heat-resistant storage stability of the toner can be preferably obtained at the same time. Furthermore, the generation of coiling of transfer paper in fixing performed at a low-temperature can be preferably suppressed, and the generation of fogging and/or fusion can be suppressed.

According to aspects of the present invention, the wax preferably has a peak temperature of the maximum endothermic peak in a range of 60° C. to 120° C. by a differential scanning calorimetric (DSC) measurement. The peak temperature is more preferably in a range of 60° C. to 90° C. When the peak temperature is within the above range, the heat-resistant storage stability, low-temperature fixability, and offset resistance can be improved with a better balance therebetween.

The toner according to aspects of the present invention needs a colorant in order to obtain a tinting power. As a colorant preferably used in aspects of the present invention, the following organic pigments, organic dyes, inorganic pigments, and black colorants, such as carbon black and a magnetic powder, may be mentioned, and colorants which have been used for toners may be mentioned.

As a yellow colorant, for example, a condensation azo compound, an isoindolinone compound, an anthraquinone compound, an azo metal complex, a methine compound, and an allyl amide compound may be mentioned. In particular, C.I. pigment yellows 12, 13, 14, 15, 17, 62, 74, 83, 93, 94, 95, 109, 110, 111, 128, 129, 147, 168, and 180 are preferably used.

As a magenta colorant, for example, a condensation azo compound, a diketo pyrrolo pyrrole compound, anthraquinone, a quinacridone compound, a basic dye lake compound, a naphthol compound, a benzimidazolone compound, a thioindigo compound, and a perylene compound may be mentioned. In particular, C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254 are preferably used.

As a cyan colorant, for example, a copper phthalocyanine compound, a derivative thereof, an anthraquinone compound, and a basic dye lake compound may be mentioned. In particular, C.I. pigment blues 1, 7, 15, 15:1, 15:2, 15:3, 15:4, 60, 62, and 66 are preferably used.

The colorant used for the toner according to aspects of the present invention is selected in consideration of the hue angle, saturation, brightness, light resistance, OHP transparency, and dispersibility in the toner.

To 100 parts by mass of the binder resin, 1 to 20 parts by mass of the colorant is preferably used.

When carbon black is used as the black colorant, as in the case described above, 1 to 20 percent by mass is preferably added. In addition, when the magnetic powder is used as the black colorant, the addition amount thereof to 100 parts by mass of the binder resin is preferably in a range of 40 to 150 parts by mass.

In the toner according to aspects of the present invention, if needed, a charge control agent may be mixed with the toner particles. In addition, a charge control agent may be added when the toner particles are manufactured. By blending a charge control agent, the charge properties can be stabilized, and the optimal triboelectrical charge amount in accordance with a development system can be controlled.

As the charge control agent, a known agent may be used, and in particular, a charge control agent which has a high electrification speed and which can also stably maintain a constant charge amount is preferable.

As a charge control agent which controls the toner to have a negative charge, an organometal compound and a chelate compound are effectively used, and for example, there may be mentioned a monoazo metal compound, an acetylacetone metal compound, and metal compounds of an aromatic oxycarboxylic acid, an aromatic dicarboxylic acid, an oxycarboxylic acid, and a dicarboxylic acid.

The toner according to aspects of the present invention is able to contain at least one of these charge control agents.

The content of the charge control agent to 100 parts by mass of the binder resin is preferably in a range of 0.01 to 20 parts by mass and more preferably in a range of 0.5 to 10 parts by mass.

The toner according to aspects of the present invention is preferably manufactured without being heated. The toner manufactured without being heated indicates a toner which is not processed at a temperature higher than the melting point of the crystalline polyester in toner manufacturing, and heating of the crystalline polyester performed in toner-material manufacturing is not taken into consideration. When the crystalline polyester is heated to its melting point or more, the crystallinity thereof may be degraded in some cases. Since the toner manufacturing is performed without heat application, the toner can be manufactured while the crystallinity of the crystalline polyester is maintained; hence, the crystallinity can be easily maintained, and the toner according to aspects of the present invention can be easily realized. As a toner manufacturing method performed without heat application, for example, a dissolution suspension method may be mentioned.

In manufacturing of a toner containing a crystalline polyester component, carbon dioxide in a high-pressure state may also be used as a dispersion medium. That is, this is a method for obtaining toner particles in which after the resin solution is dispersed in carbon dioxide in a high-pressure state for granulation, and an organic solvent contained in particles formed by the granulation is removed by extraction into the phase of carbon dioxide, carbon dioxide is separated by releasing the pressure to form the toner particles. The carbon dioxide in a high-pressure state preferably used in aspects of the present invention is liquid or supercritical carbon dioxide.

In this case, the liquid carbon dioxide indicates carbon dioxide present under temperature and pressure conditions of a region surrounded by the gas-liquid boundary line passing through the triple point (temperature=−57° C., pressure=0.5 MPa) and the critical point (temperature=31° C., pressure=7.4 MPa) on the phase diagram of carbon dioxide, the isothermal line of the critical point, and the solid-liquid boundary line. In addition, the carbon dioxide in a supercritical state indicates carbon dioxide under temperature and pressure conditions above the critical point of carbon dioxide described above.

According to aspects of the present invention, an organic solvent may be contained as another component in the dispersion medium. In this case, carbon dioxide and the organic solvent preferably form a homogeneous phase.

According to this method, the granulation is performed under high pressure conditions; hence, it is preferable since the crystallinity of the crystalline polyester component is not only easily maintained but can also be increased.

Hereinafter, a method for manufacturing toner particles using liquid or supercritical carbon dioxide, which is preferably used to obtain the toner particles according to aspects of the present invention, will be described by way of example.

First, the resin (a), a colorant, a wax, and other additives, if needed, are added to an organic solvent capable of dissolving the resin (a) and are then uniformly dissolved or dispersed using a dispersion machine, such as a homogenizer, a ball mill, a colloid mill, or an ultrasonic dispersion machine.

Next, the solution or the dispersion liquid (hereinafter, simply referred to as "resin (a) solution") thus obtained is dispersed in liquid or supercritical carbon dioxide to form oil droplets.

At this stage, a dispersant must be dispersed in the liquid or the supercritical carbon dioxide used as a dispersion medium. As the dispersant, for example, any of an inorganic particle dispersant, an organic particle dispersant, and a mixture therebetween may be used, and in accordance with the purpose, the dispersants may be used alone, or at least two thereof may be used in combination.

As the inorganic particle dispersant, for example, inorganic particles of silica, alumina, zinc oxide, titania, and calcium oxide may be mentioned.

As the organic particle dispersant, for example, there may be mentioned a vinyl resin, a urethane resin, an epoxy resin, an ester resin, a polyamide, a polyimide, a silicone resin, a fluororesin, a phenol resin, a melamine resin, a benzoguanamine resin, a urea resin, an aniline resin, an ionomer resin, a polycarbonate, a cellulose, and mixtures thereof.

When organic resin particles formed of an amorphous resin are used as a dispersant, since carbon dioxide is dissolved therein, and the resin is plasticized thereby, the glass transition temperature thereof is decreased; hence, the particles are liable to be agglomerated when the granulation is performed. Accordingly, it is preferable to use a resin having crystallinity as the organic resin particles, and when an amorphous resin is used, a cross-linking structure is preferably employed. In addition, particles formed of amorphous resin particles coated with a crystalline resin may also be used.

Although the above dispersants may be used without being modified, surface-modified dispersants obtained by various treatments may also be used in order to improve adsorption properties on the surfaces of oil droplets in the granulation. In particular, for example, surface treatments using a silane, a titanate, and an aluminate coupling agent, surface treatments using various surfactants, and coating treatments using a polymer may be mentioned.

Since the dispersant adsorbed on the surface of the oil droplet still remains after the toner particles are formed, when resin particles are used as the dispersant, toner particles having surfaces covered with the resin particles can be formed.

As the particle diameter of the resin particles, the number average particle diameter (D1) is preferable in a range of 30 to 300 nm. The number average particle diameter (D1) is more preferably in a range of 50 to 100 nm. When the particle diameter of the resin particles is too small, the stability of the oil droplet in the granulation tends to decrease. When the particle diameter of the resin particles is too large, it becomes difficult to control the oil droplet to have a desired particle diameter.

In addition, to 100 parts by mass of a solid content in the resin (a) solution used for the formation of oil droplets, the content of the resin particles is preferably in a range of 3.0 to 15.0 parts by mass and can be appropriately adjusted in accordance with the stability and the desired particle diameter of the oil droplet.

According to aspects of the present invention, as a method for dispersing the dispersant in liquid or supercritical carbon dioxide, any method may be used. As a concrete example, for example, there may be mentioned a method in which the dispersant and liquid or supercritical carbon dioxide are charged in a container and are then directly dispersed by stirring or ultrasonic irradiation. In addition, a method in which a dispersion liquid containing the dispersant dispersed in an organic solvent is charged in a container containing liquid or supercritical carbon dioxide using a high pressure pump may also be mentioned by way of example.

Furthermore, according to aspects of the present invention, any methods in which the resin (a) solution is dispersed in liquid or supercritical carbon dioxide may also be used. As a concrete example, for example, a method in which the resin (a) solution is charged in a container containing the dispersant dispersed in liquid or supercritical carbon dioxide by using a high pressure pump may be mentioned. In addition, liquid or supercritical carbon dioxide dispersing the dispersant may be charged in a container containing the resin (a) solution.

According to aspects of the present invention, it is important that the dispersion medium of liquid or supercritical carbon dioxide be a single phase. When the resin (a) solution is dispersed in liquid or supercritical carbon dioxide for granulation, the organic solvent in the oil droplet is partially transferred into the dispersion medium. At this stage, when the phase of the carbon dioxide and the phase of the organic solvent are separated from each other, it is not preferable since the stability of the oil droplet is degraded. Hence, the temperature and pressure of the dispersion medium, and the amount of the resin (a) solution to the liquid or supercritical carbon dioxide are preferably adjusted within a range in which the carbon dioxide and the organic solvent can form a homogeneous phase.

In addition, the temperature and pressure of the dispersion must be carefully adjusted in consideration of granulation properties (degree of easiness of formation of oil droplets) and/or the solubility of the constituent elements in the resin (a) solution to the dispersion medium. For example, depending on the temperature and/or the pressure conditions, the resin (a) and/or the wax in the resin (a) solution may be dissolved in the dispersion medium in some cases. In general, although the solubility of the above components to the dispersion medium is decreased as the temperature and/or the pressure is decreased, the oil droplets thus formed are liable to be agglomerated or united together, and hence the granulation properties are degraded. On the other hand, although the granulation properties are improved as the temperature and/or the pressure is increased, the above components tend to be easily dissolved in the dispersion medium.

Furthermore, the temperature of the dispersion medium must be lower than the melting point of the crystalline polyester component so as not to degrade the crystallinity thereof.

Hence, in the manufacturing of the toner particles, the temperature of the dispersion medium is preferably lower than the melting point of the crystalline polyester component by 20° C. or more.

In addition, the pressure in the container in which the dispersion medium is formed is preferably in a range of 3 to 20 MPa and more preferably in a range of 5 to 15 MPa. When at least one component other than carbon dioxide is contained in the dispersion medium, the pressure according to aspects of the present invention indicates the total pressure.

In addition, the ratio of carbon dioxide occupied in the dispersion medium according to aspects of the present invention is preferably 70 percent by mass or more, more preferably 80 percent by mass or more, and even more preferably 90 percent by mass or more.

After the granulation is completed as described above, the organic solvent remaining in the oil droplets is removed through the dispersion medium of liquid or supercritical carbon dioxide. In particular, liquid or supercritical carbon dioxide is further mixed with the dispersion medium in which the oil droplets are dispersed to extract the remaining organic solvent into the phase of carbon dioxide, and this carbon dioxide containing the organic solvent is further replaced with liquid or supercritical carbon dioxide.

The mixing of the dispersion medium and the liquid or supercritical carbon dioxide may be performed by adding liquid or supercritical carbon dioxide at a pressure higher than that of the dispersion medium thereto or by adding the dispersion medium to liquid or supercritical carbon dioxide at a pressure lower than that thereof.

In addition, as a method for further replacing carbon dioxide containing the organic solvent with liquid or supercritical carbon dioxide, a method may be mentioned in which while the pressure inside the container is maintained constant, liquid or supercritical carbon dioxide is allowed to flow therethrough. In this case, the replacement is performed while the toner particles thus formed are trapped by a filter.

In the state in which the replacement with liquid or supercritical carbon dioxide is not enough, and the organic solvent remains in the dispersion medium, when the pressure inside the container is reduced to recover the toner particles, by condensation of the organic solvent, the toner particles may be remelted or may be united together in some cases. Hence, the replacement with liquid or supercritical carbon dioxide must be performed until the organic solvent is completely removed. The amount of liquid or supercritical carbon dioxide to be allowed to flow through is, with respect to the volume of the dispersion medium, preferably 1 to 100 times, more preferably 1 to 50 times, and most preferably 1 to 30 times.

When the pressure inside the container is reduced, and the toner particles are recovered from the dispersion containing liquid or supercritical carbon dioxide in which the toner particles are dispersed, although the pressure may be rapidly reduced to ordinary pressure by one step, the pressure may be gradually reduced stepwise by providing containers in which the pressures are independently controlled. A reduction rate of the pressure is preferably set in a range in which the toner particles are not foamed.

In addition, the organic solvent and liquid or supercritical carbon dioxide used according to aspects of the present invention can be recycled.

Furthermore, the toner according to aspects of the present invention is preferably processed by an annealing treatment (heat treatment) at a temperature lower than the melting point of the crystalline polyester.

An annealing treatment temperature may be determined in accordance with a peak temperature of the endothermic peak derived from the crystalline polyester component which is obtained by measurement of toner particles obtained beforehand using a differential scanning calorimeter (DSC). In particular, the annealing treatment is preferably performed in a temperature range from a temperature obtained by subtracting 15° C. from a peak temperature obtained by a DSC measurement performed at a temperature rise rate of 10.0° C./min to a temperature by subtracting 5° C. therefrom. A temperature range from a temperature obtained by subtracting 10° C. from the peak temperature to a temperature obtained by subtracting 5° C. therefrom is more preferable.

According to aspects of the present invention, the annealing treatment may be performed at any stage after the step of forming toner particles and may be performed, for example, on particles in a slurry state, at a step before an external addition step, or further at a step thereafter.

In addition, an annealing treatment time may be appropriately adjusted in accordance with the ratio, type, and crystalline state of the crystalline polyester component in the toner and, in general, is preferably in a range of 1 to 50 hours. The effect of recrystallization is not obtained when the annealing treatment time is less than 1 hour. On the other hand, even if the annealing treatment is more than 50 hours, a further effect cannot be expected. Hence, the annealing treatment time is more preferably in a range of 5 to 24 hours.

To the toner particles according to aspects of the present invention, an inorganic fine powder is preferably added as a fluidity improver.

As the inorganic fine powder to be added to the toner particles according to aspects of the present invention, a fine powder, such as a silica fine powder, a titanium oxide fine powder, an alumina fine powder, or a compound oxide fine powder obtained therefrom may be mentioned. A silica fine powder and a titanium oxide fine powder are particularly preferable among these inorganic fine powders.

As the silica fine powder, for example, dry process silica or fumed silica, each of which is formed by vapor-phase oxidation of a silicon halide, and wet process silica manufactured from water glass may be mentioned. As the inorganic fine powder, dry process silica in which the amount of silanol groups on the surface and the inside of the silica fine powder is small and the amounts of $Na_2O$ and $SO_3^{2-}$ are small is more preferable. In addition, as the dry process silica, for example, a compound fine powder of silica and another metal oxide, which is manufactured by using a metal halide, such as aluminum chloride or titanium chloride, with a silicon halide in a manufacturing process, may also be used.

The inorganic fine powder is preferably externally added to the toner particles for fluidity improvement of the toner and uniform electrification of the toner particles. Since adjustment of charge amount of the toner, improvement in environmental stability, and improvement of properties under a high humidity environment can be achieved by a hydrophobic treatment on the inorganic fine powder, an inorganic fine powder processed by a hydrophobic treatment is preferably used.

As a treatment agent for the hydrophobic treatment on the inorganic fine powder, for example, non-modified silicone varnishes, various modified silicone varnishes, non-modified silicone oils, various modified silicone oils, silane compounds, silane coupling agents, other organic silicone compounds, and organic titanium compounds may be mentioned. These treatment agents may be used alone or in combination.

Among those mentioned above, an inorganic fine powder processed by a silicone oil is preferable. More preferably, a hydrophobic-treated inorganic fine powder which is processed by a silicone oil simultaneously with or after a hydrophobic treatment using a coupling agent is preferably used since the charge amount of the toner particles can be maintained high even under a high-humidity environment, and the selection development can be reduced.

In order to impart excellent fluidity, the addition amount of the inorganic fine powder is, with respect to 100 parts by mass of the toner particles, preferably in a range of 0.1 to 4.0 parts by mass and more preferably in a range of 0.2 to 3.5 parts by mass.

The toner according to aspects of the present invention preferably has a weight average particle diameter (D4) in a range of 3.0 to 8.0 μl. The weight average particle diameter is more preferably in a range of 5.0 to 7.0 μm. A toner having the weight average particle diameter (D4) as described above is preferably used since reproducibility of dots can be sufficiently satisfied as well as improvement in handling properties.

Furthermore, the ratio D4/D1 of the weight average particle diameter (D4) to the number average particle diameter (D1) is preferably 1.25 or less. The ratio D4/D1 is more preferably 1.20 or less.

Measurement methods of various properties of the toner according to aspects of the present invention will be described below.

<Method for Measuring Endothermic Peak Temperature Tp Derived from Binder Resin of Toner>

An endothermic peak temperature Tp derived from a binder resin in the toner according to aspects of the present invention is measured under the following conditions by using DSC Q1000 (manufactured by TA Instruments).

Temperature rise rate: 10° C./min

Measurement start temperature: 20° C.

Measurement finish temperature: 180° C.

The temperature correction of a device detection portion uses the melting points of indium and zinc, and the correction of heat quantity uses the heat of fusion of indium.

In particular, approximately 5 mg of the toner is precisely weighed and is placed on a pan made of silver, and then measurement is performed. An empty pan made of silver is used as a reference. A peak temperature of the maximum endothermic peak is represented by Tp.

When the maximum endothermic peak (endothermic peak derived from a binder resin) obtained by the measurement is not overlapped with the endothermic peak of a wax, the obtained maximum endothermic peak is used simply as the endothermic peak derived from the binder resin. On the other hand, when the endothermic peak of the wax is overlapped with the maximum endothermic peak, the endothermic amount derived from the wax must be subtracted from the maximum endothermic peak.

For example, by the method described below, the endothermic peak derived from the binder resin can be obtained by subtracting the endothermic amount derived from the wax from the maximum endothermic peak thus obtained.

First, a DSC measurement of the wax itself is performed separately, and the endothermic properties thereof are obtained. Subsequently, the wax content in the toner is measured. Although the measurement of the wax content in the toner is not particularly limited, for example, the measurement can be performed by the peak separation in a DSC measurement or a known structural analysis. Subsequently, the endothermic amount derived from the wax is calculated from the wax content in the toner, and this endothermic amount may be subtracted from the maximum endothermic peak. When the wax is easily dissolved with a resin component, it is necessary that after the content of the wax is multiplied by a compatible rate, the endothermic amount caused by the wax is calculated and subtracted. The compatible rate is calculated from the value obtained by dividing the endothermic amount obtained from a mixture of a wax and a molten mixture of resin components at a predetermined ratio by the theoretical endothermic amount calculated from the endothermic amount of the molten mixture and that of the wax itself obtained beforehand.

In addition, the melting point of the crystalline polyester and the melting point of the block polymer are measured in a manner similar to that described above except for the case in which each of which is used as a sample.

<Method for Measuring Melting Point of Wax>

The melting point of a wax was measured under the following conditions by using DSC Q1000 (manufactured by TA Instruments).

Temperature rise rate: 10° C./min

Measurement start temperature: 20° C.

Measurement finish temperature: 180° C.

The temperature correction of a device detection portion uses the melting points of indium and zinc, and correction of heat quantity uses the heat of fusion of indium.

In particular, approximately 2 mg of a sample is precisely weighed and is placed on a pan made of silver, and measurement is performed using an empty pan made of silver as a reference. The measurement is performed in such a way that the temperature is increased to 200° C. once and is then decreased to 30° C., followed by again increasing the temperature. A temperature indicating the maximum endothermic peak of a DSC curve in a temperature range of 30° C. to 200° C. in a second temperature rise step is defined as the melting point of the wax. When a plurality of peaks is present, the maximum endothermic peak is a peak having the highest endotherm.

<Method for Measuring Glass Transition Temperature Tg of Amorphous Resin>

A method for measuring Tg according to aspects of the present invention was performed under the following conditions by using DSC Q1000 (manufactured by TA Instruments).

<<Measurement Condition>>

Modulation mode

Temperature rise rate: 0.5° C./min

Modulation temperature amplitude: ±1.0° C./min

Measurement start temperature: 25° C.

Measurement finish temperature: 130° C.

When the temperature rise rate was changed, a new measurement sample was prepared. An increase in temperature was performed once, and a DSC curve was obtained by plotting "Reversing Heat Flow" along a vertical axis, so that the onset value was regarded as Tg according to aspects of the present invention.

<Method for Measuring Loss Modulus G" of Toner>

Measurement is performed using a viscoelasticity measurement apparatus (rheometer) ARES (manufactured by Rheometrics Scientific Ltd.). Although the outline of the measurement is described in ARES operation manual 902-30004 (August, 1997 version) and 902-00153 (July, 1993 version) published by Rheometrics Scientific Ltd., the procedure is as follows.

Measurement jig: torsion rectangular

Measurement sample: a rectangular parallelepiped type toner sample having a width of approximately 12 mm, a height of approximately 20 mm, and a thickness of approximately 2.5 mm) is formed by using a pressure molding machine (15 kN is maintained for 1 minute at ordinary temperature). As the pressure molding machine, 100 kN press NT-100H manufactured by NPa system Co., Ltd. is used.

Figure 2:
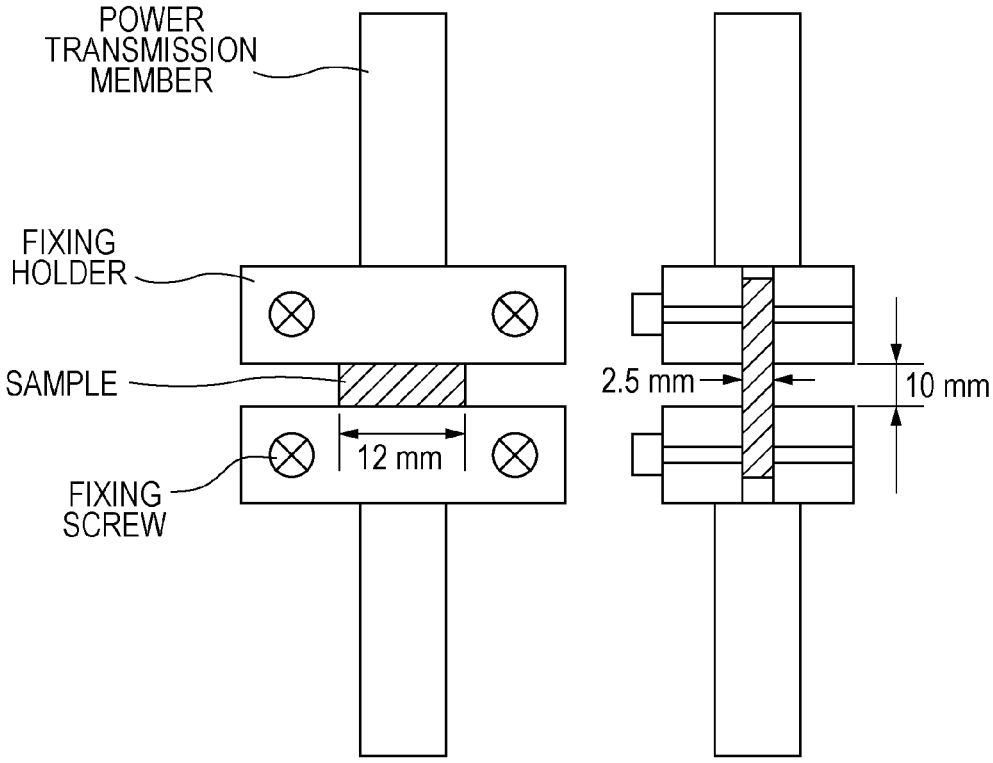
FIG. 2 is a schematic view of a measurement sample and jigs for measuring the viscoelasticity of the toner according to aspects of the present invention.

After the jig and the sample are held at room temperature (23° C.) for 1 hour, the sample is fitted to the jig (see FIG. 2). As shown in the figure, the sample is fixed so that a measurement portion has a width of approximately 12 mm, a thickness of approximately 2.5 mm, and a height of 5 mm. After temperature control to a measurement start temperature of 30.00° C. is carried out for 10 minutes, the measurement is performed under the following conditions.

Measurement frequency: 6.28 radians per second

Setting of measurement strain: 0.1% is set as an initial value, and measurement is performed by an automatic measurement mode.

Extension correction of sample: Adjustment is performed by an automatic measurement mode.

Measurement temperature: Temperature is increased at a rate of 2° C./m from 30° C. to 150° C.

Measurement interval: Viscoelasticity data is measured every 30 seconds or every 1° C.

The data is transferred to RSI Orchesrator (control, data collection, and analysis software) (manufactured by Rheometrics Scientific Ltd.) operable on Windows 2000 manufactured by Microsoft Corp., through an interface.

Among the data, the values of the loss modulus of the toner at temperatures, Tp−20° C., Tp−10° C., Tp−5° C., Tp+5° C., Tp+10° C., and Tp+30° C., are read with respect to the value at Tp obtained by the above <method for measuring endothermic peak temperature Tp of toner> (see FIG. 3).

<Method for Measuring Weight Average Particle Diameter (D4) and Number Average Particle Diameter (D1)>

The weight average particle diameter (D4) and the number average particle diameter (D1) of the toner are calculated as follows. As a measurement apparatus, a precision particle size distribution measurement apparatus "Coulter Counter Multisizer 3" (registered trademark, manufactured by Beckman Coulter Inc.) including a 100-μm aperture tube in accordance with a pore electrical resistance method is used. For setting of measurement conditions and analysis of measurement data, attached dedicated software "Beckman Coulter Multisizer 3 Version 3.51" (manufactured by Beckman Coulter Inc.) is used. In addition, the measurement is performed by 25,000 effective measurement channels.

As an aqueous electrolytic solution used for measurement, a solution obtained by dissolving reagent grade sodium chloride in ion exchange water to have a concentration of approximately 1 percent by mass, such as "ISOTON II" (manufactured by Beckman Coulter Inc.), may be used.

In addition, before the measurement and analysis are performed, the dedicated software is set as described below.

On a "change of standard operation method (SOM)" screen of the dedicated software, the total count number of a control mode is set to 50,000 particles, the number of times of measurement is set to 1, and the value obtained by using "standard particles 10.0 μm" (manufactured by Beckman Coulter, Inc.) is set as a Kd value. A threshold value and a noise level are automatically set by pressing a "threshold value/noise level measurement button". In addition, the current is set to 1,600 μA, the gain is set to 2, the electrolytic solution is set to ISOTON II, and a check mark is placed in the column of "flush for aperture tube after measurement".

On a "setting for conversion from pulse to particle diameter" screen of the dedicated software, a bin distance is set to a logarithmic particle diameter, the number of particle diameter bins is set to 256, and the particle diameter range is set to from 2 to 60 μl.

A particular measurement method is as follows.

(1) After approximately 200 ml of the aqueous electrolytic solution is received in a 250-ml round-bottom beaker made of glass dedicated for the Multisizer 3, and this beaker is set in a sample stand, stirring with a stirrer rod is performed at 24 rotations/second in an anticlockwise direction. Next, by a "flush of aperture" function of the dedicated software, dirt and air bubbles in the aperture tube are removed beforehand.

(2) Approximately 30 ml of the aqueous electrolytic solution is received in a 100-ml flat-bottom beaker made of glass. To this water, approximately 0.3 ml of a diluted solution is added which is prepared by diluting "CONTAMINON N" (an aqueous solution at a concentration of 10 percent by mass of a neutral detergent for washing precision measurement apparatuses having a pH of 7 which is composed of a nonionic surfactant, an anionic surfactant, and an organic builder, manufactured by Wako Pure Chemical Industries, Ltd.) with ion exchange water to approximately 3 times the original mass.

(3) An ultrasonic dispersion machine having an electrical output of 120 W "Ultrasonic Dispersion System TETORA 150" (manufactured by Nikkaki Bios Co.) in which 2 oscillators each having an oscillatory frequency of 50 kHz are incorporated so that their phases are shifted by 180° to each other. In a water tank of the ultrasonic dispersion machine, approximately 3.3 liters of ion exchange water is charged, and approximately 2 ml of CONTAMINON N is added to this water tank.

(4) The beaker of the above (2) is set in a beaker fixing hole of the ultrasonic dispersion machine, and the ultrasonic dispersion machine is started. Then, the height position of the beaker is adjusted so as to maximize the resonant state of the surface of the aqueous electrolytic solution in the beaker.

(5) In the state in which the aqueous electrolytic solution in the beaker of the above (4) is irradiated with ultrasonic waves, approximately 10 mg of the toner is added little by little to the aqueous electrolytic solution and is dispersed therein. In addition, the ultrasonic dispersion treatment is further continued for 60 seconds. In the ultrasonic dispersion treatment, appropriate adjustment is performed so that the water temperature of the water tank is in a range of 10° C. to 40° C.

(6) To the round-bottom beaker of the above (1) placed inside the sample stand, the aqueous electrolytic solution of the above (5) in which the toner is dispersed is dripped by using a pipette, and the measurement concentration is adjusted to approximately 5%. Next, the measurement is performed until the number of measured particles reaches 50,000.

(7) The measurement data are analyzed by using the above dedicated software attached to the apparatus, and the weight average particle diameter (D4) and the number average particle diameter (D1) are calculated. When the dedicated software is set to graph/volume percent, an "average diameter" on an "analysis/volume statistic value (arithmetic average)" screen indicates the weight average particle diameter (D4). When the dedicated software is set to graph/number percent, an "average diameter" on an "analysis/number statistic value (arithmetic average)" screen indicates the number average particle diameter (D1).

<Method for Measuring Molecular Weight Distribution, Peak Molecular Weight, and Number Average Molecular Weight of Resin by Gel Permeation Chromatograph (GPC)>

As for the molecular weight distribution, the peak molecular weight, and the number average molecular weight of the resin, the tetrahydrofuran (THF) soluble component of the resin was measured by a GPC (gel permeation chromatography) using THF as a solvent. The measurement conditions are as follows.

(1) Preparation of Measurement Sample

After the resin (sample) and THF were mixed together to have a concentration of approximately 0.5 to 5 mg/ml (such as approximately 5 mg/ml) and were held at room temperature for several hours (such as 5 to 6 hours), the mixture was sufficiently shook so that THF and the sample are well mixed together until agglomerates thereof disappeared. Furthermore, the mixture thus obtained was held at room temperature for 12 hours or more (such as 24 hours). At this stage, a time from the start of mixing the sample and THF to the end of holding the sample was set to 24 hours or more.

Subsequently, the mixture was allowed to pass through a sample treatment filter (pore size: 0.45 to 0.5 μl, Maishoridisck H-25-2 (manufactured by TOSOH CORP.) and Ekicrodis 25CR (manufactured by German Science Japan Ltd) were preferably used) and was then used as the sample of GPC.

(2) Measurement of Sample

A column was stabilized in a heat chamber at 40° C., THF as a solvent was allowed to pass through the column at this temperature at a flow rate of 1 ml/min, and 50 to 200 μl of a THF sample solution of a resin having an adjusted sample concentration of 0.5 to 5 mg/ml was then charged for measurement.

In the molecular weight measurement of the sample, the molecular weight distribution of the sample was calculated from the relationship between the count number and the legalism value of a calibration curve prepared from several types of monodisperse polystyrene standard samples.

As standard polystyrene samples for the calibration curve preparation, samples having molecular weights of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$ (manufactured by Pressure Chemical Co., or TOSOH CORP.) were used. In addition, an RI (refractive index) detector was used as the detector.

As the column, in order to precisely measure a molecular weight region of $1\times10^3$ to $2\times10^6$, a plurality of commercially available polystyrene gel columns was used in combination as described below. The measurement conditions of GPC according to aspects of the present invention are as follows.

[GPC Measurement Condition]

Apparatus: LC-GPC 150C (manufactured by Waters)

Column: Seven columns, in series, of KF801, 802, 803, 804, 805, 806, and 807 (manufactured by Shodex)

Column temperature: 40° C.

Mobile phase: THF (tetrahydrofuran)

<Method for Measuring Particle Diameter of Resin Particles>

By using a microtrack particle size distribution measurement apparatus HRA (X-100) (manufactured by Nikkiso Co., Ltd.), the particle diameter of the resin particles was measured by a range setup of 0.001 to 10 μm as the number average particle diameter (μm or nm). In this measurement, water was selected as a diluent solvent.

<Method for Measuring Ratio of Segment Capable of Forming Crystalline Structure>

The ratio of the segment capable of forming a crystalline structure in the resin (a) is measured by $^1$H-NMR under the following conditions.

Measurement apparatus: FT NMR apparatus JNM-EX400 (manufactured by JEOL Co., Ltd.)

Measurement frequency: 400 MHz

Pulse condition: 5.0 μs

Frequency range: 10,500 Hz

Number of acquisition: 64 times

Measurement temperature: 30° C.

Sample: 50 mg of a measurement block polymer is placed in a sample tube having an inside diameter of 5 mm, deuterated chloroform ($CDCl_3$) is then added as a solvent, and this mixture is dissolved using a temperature-controlled bath at 40° C. for preparation.

From an obtained $^1$H-NMR chart, among peaks belonging to constituent elements of the segment capable of forming a crystalline structure, a peak independent from peaks belonging to the other constituent elements is selected, and an integral value S1 of this peak is calculated. In a manner similar to that described above, among peaks belonging to constituent elements of an amorphous segment, a peak independent from peaks belonging to the other constituent elements is selected, and an integral value S2 of this peak is calculated.

The ratio of the segment capable of forming a crystalline structure can be obtained as described below using the integral value $S_1$ and the integral value $S_2$. In the following formula, $n_1$ and $n_2$ each indicate the number of hydrogen of the constituent element to which a peak of interest of each segment belongs.

$$\text{Ratio of segment capable of forming crystalline structure (mol \%)}=\{(S_1/n_1)/((S_1/n_1)\}+(S_2/n_2))\}\times100$$

The ratio (mol %) of the segment capable of forming crystalline structure is converted into percent by mass (mass %) using the molecular weight of each component.

EXAMPLES

Hereinafter, although the present invention will be described in more detail with reference to examples, the present invention is not limited thereto.

<Synthesis of Crystalline Polyester 1>

The following raw materials were charged in a two neck flask dried by heating while nitrogen was supplied therein.

| | |
|---|---|
| Sebacic acid | 136.8 parts by mass |
| 1,4-butanediol | 63.2 parts by mass |
| Dibutyltin oxide | 0.1 parts by mass |

After the inside of the flask was replaced with nitrogen by a reduced-pressure operation, stirring was performed at 180° C. for 6 hours. Then, the temperature was gradually increased to 230° C. under reduced-pressure conditions while stirring was performed and was further maintained for 2 hours. When the mixture was changed into a viscous state, air cooling was performed to stop the reaction, so that a crystalline polyester 1 was synthesized. The physical properties of the crystalline polyester 1 are shown in Table 1.

<Synthesis of Crystalline Polyester 2>

Except that the raw materials were changed as shown below, a crystalline polyester 2 was synthesized in the same manner as that of the synthesis of the crystalline polyester 1. The physical properties of the crystalline polyester 2 are shown in Table 1.

| | |
|---|---|
| Sebacic acid | 76.0 parts by mass |
| Adipic acid | 55.0 parts by mass |
| 1,4-butanediol | 69.0 parts by mass |
| Dibutyltin oxide | 0.1 parts by mass |

<Synthesis of Crystalline Polyester 3>

Except that the raw materials were changed as shown below, a crystalline polyester 3 was synthesized in the same manner as that of the synthesis of the crystalline polyester 1. The physical properties of the crystalline polyester 3 are shown in Table 1.

| | |
|---|---|
| Dodecanedioic acid | 112.2 parts by mass |
| 1,10-decanediol | 87.8 parts by mass |
| Dibutyltin oxide | 0.1 parts by mass |

<Synthesis of Crystalline Polyester 4>

Except that the raw materials were changed as shown below, a crystalline polyester 4 was synthesized in the same manner as that of the synthesis of the crystalline polyester 1. The physical properties of the crystalline polyester 4 are shown in Table 1.

| | |
|---|---|
| Sebacic acid | 107.0 parts by mass |
| Adipic acid | 27.0 parts by mass |
| 1,4-butanediol | 66.0 parts by mass |
| Dibutyltin oxide | 0.1 parts by mass |

<Synthesis of Crystalline Polyester 5>

Except that the raw materials were changed as shown below, a crystalline polyester 5 was synthesized in the same manner as that of the synthesis of the crystalline polyester 1. The physical properties of the crystalline polyester 5 are shown in Table 1.

| | |
|---|---|
| Octadecanedioic acid | 152.6 parts by mass |
| 1,4-butanediol | 47.4 parts by mass |
| Dibutyltin oxide | 0.1 parts by mass |

<Synthesis of Crystalline Polyester 6>

Except that the raw materials were changed as shown below, a crystalline polyester 6 was synthesized in the same manner as that of the synthesis of the crystalline polyester 1. The physical properties of the crystalline polyester 6 are shown in Table 1.

| | |
|---|---|
| Sebacic acid | 112.5 parts by mass |
| Adipic acid | 22.0 parts by mass |
| 1,4-butanediol | 65.5 parts by mass |
| Dibutyltin oxide | 0.1 parts by mass |

<Synthesis of Crystalline Polyester 7>

Except that the raw materials were changed as shown below, a crystalline polyester 7 was synthesized in the same manner as that of the synthesis of the crystalline polyester 1. The physical properties of the crystalline polyester 7 are shown in Table 1.

| | |
|---|---|
| Tetradecanedioic acid | 135.0 parts by mass |
| 1,6-hexanediol | 65.0 parts by mass |
| Dibutyltin oxide | 0.1 parts by mass |

<Synthesis of Crystalline Polyester 8>

Except that the raw materials were changed as shown below, a crystalline polyester 8 was synthesized in the same manner as that of the synthesis of the crystalline polyester 1. The physical properties of the crystalline polyester 8 are shown in Table 1.

| | |
|---|---|
| Sebacic acid | 125.0 parts by mass |
| 1,6-hexanediol | 75.0 parts by mass |
| Dibutyltin oxide | 0.1 parts by mass |

<Synthesis of Crystalline Polyester 9>

Except that the raw materials were changed as shown below, a crystalline polyester 9 was synthesized in the same manner as that of the synthesis of the crystalline polyester 1. The physical properties of the crystalline polyester 9 are shown in Table 1.

| | |
|---|---|
| Sebacic acid | 138.0 parts by mass |
| 1,4-butanediol | 62.0 parts by mass |
| Dibutyltin oxide | 0.1 parts by mass |

TABLE 1

| | Mn | Mw | Tp (° C.) |
|---|---|---|---|
| CRYSTALLINE POLYESTER 1 | 4,900 | 11,300 | 66 |
| CRYSTALLINE POLYESTER 2 | 5,000 | 10,500 | 50 |
| CRYSTALLINE POLYESTER 3 | 5,000 | 10,500 | 87 |
| CRYSTALLINE POLYESTER 4 | 5,100 | 11,200 | 58 |
| CRYSTALLINE POLYESTER 5 | 4,900 | 10,800 | 83 |
| CRYSTALLINE POLYESTER 6 | 5,000 | 11,500 | 61 |
| CRYSTALLINE POLYESTER 7 | 4,900 | 10,800 | 74 |
| CRYSTALLINE POLYESTER 8 | 5,000 | 11,000 | 67 |
| CRYSTALLINE POLYESTER 9 | 12,200 | 58,600 | 65 |

<Synthesis of Amorphous Resin 1>

The following raw materials were charged in a two neck flask dried by heating while nitrogen was supplied therein.

| | |
|---|---|
| Polyoxypropylene (2.2)-2,2-bis(4-hydroxyphenyl)propane | 30.0 parts by mass |
| Polyoxyethylene (2.2)-2,2-bis(4-hydroxyphenyl)propane | 34.0 parts by mass |
| Terephthalic acid | 30.0 parts by mass |
| Fumaric acid | 6.0 parts by mass |
| Dibutyltin oxide | 0.1 parts by mass |

After the inside of the flask was replaced with nitrogen by a reduced-pressure operation, stirring was performed at 215° C. for 5 hours. Then, the temperature was gradually increased to 230° C. under reduced-pressure conditions while stirring was performed and was further maintained for 5 hours to promote a reaction. An amorphous resin 1, which was an amorphous polyester, was obtained. The amorphous resin 1 had an Mn of 2,200, an Mw of 9,800, and a Tg of 60° C.

<Synthesis of Amorphous Resin 2>

The following raw materials were charged in a two neck flask dried by heating while nitrogen was supplied therein.

| | |
|---|---|
| Polyoxypropylene (2.2)-2,2-bis(4-hydroxyphenyl)propane | 30.0 parts by mass |
| Polyoxyethylene (2.2)-2,2-bis(4-hydroxyphenyl)propane | 33.0 parts by mass |
| Terephthalic acid | 21.0 parts by mass |
| Trimellitic anhydride | 1.0 parts by mass |
| Fumaric acid | 3.0 parts by mass |
| Dodecenyl succinic acid | 12.0 parts by mass |
| Dibutyltin oxide | 0.1 parts by mass |

After the inside of the flask was replaced with nitrogen by a reduced-pressure operation, stirring was performed at 215° C. for 5 hours. Then, the temperature was gradually increased to 230° C. under reduced-pressure conditions while stirring was performed and was further maintained for 2 hours. When the mixture was changed into a viscous state, air cooling was performed to stop the reaction, so that an amorphous resin 2, which was an amorphous polyester, was synthesized. The amorphous resin 2 had an Mn of 7,200, an Mw of 43,000, and a Tg of 63° C.

<Synthesis of Amorphous Resin 3>

| | |
|---|---|
| Xylylene diisocyanate (XDI) | 117.0 parts by mass |
| Cyclohexane dimethanol (CHDM) | 83.0 parts by mass |
| Acetone | 200 parts by mass |

The above raw materials were charged in a reactor equipped with a stirring device and a thermometer while nitrogen gas replacement was performed. The temperature was increased to 50° C., and a urethane-forming reaction was performed over 15 hours. Then, 3.0 parts by mass of tertiary butyl alcohol was added so as to modify the isocyanate terminal. Acetone functioning as a solvent was distilled off, and an amorphous resin 3 was obtained. The amorphous resin 3 had an Mn of 4,400 and Mw of 20,000.

<Synthesis of Block Polymer 1>

| | |
|---|---|
| Crystalline polyester 1 | 210.0 parts by mass |
| Xylylene diisocyanate (XDI) | 56.0 parts by mass |
| Cyclohexane dimethanol (CHDM) | 34.0 parts by mass |
| Tetrahydrofuran (THF) | 300 parts by mass |

The above raw materials were charged in a reactor equipped with a stirring device and a thermometer while nitrogen gas replacement was performed. The temperature was increased to 50° C., and a urethane-forming reaction was performed over 15 hours. Then, 3.0 parts by mass of tertiary butyl alcohol was added so as to modify the isocyanate terminal. THF functioning as a solvent was distilled off, and a block polymer 1 was obtained. The physical properties of the obtained block polymer 1 are shown in Table 3.

<Synthesis of Block Polymers 2 to 24>

In the synthesis of the block polymer 1, the materials and the addition amounts were changed as shown in Table 2, so that block polymers 2 to 24 were obtained. The physical properties of the obtained block polymers 2 to 24 are shown in Table 3.

<Synthesis of Block Polymer 25>

| | |
|---|---|
| Crystalline polyester 1 | 195.0 parts by mass |
| Amorphous polyester 1 | 105.0 parts by mass |
| Dibutyltin oxide | 0.1 parts by mass |

The above raw materials were charged in a reactor equipped with a stirring device and a thermometer while nitrogen gas replacement was performed. The temperature was increased to 200° C., and an ester reaction was performed over 5 hours. A block polymer 25 was obtained. The physical properties of the obtained block polymer 25 are shown in Table 3.

TABLE 2

| | SEGMENT CAPABLE OF FORMING CRYSTALLINE STRUCTURE | | DIISOCYANATE | | ADDITION COMPONENT | | MODIFICATION AGENT | |
|---|---|---|---|---|---|---|---|---|
| BLOCK POLYMER No. | CRYSTALLINE POLYESTER No. | ADDITION AMOUNT (PARTS BY MASS) | TYPE | ADDITION AMOUNT (PARTS BY MASS) | TYPE | ADDITION AMOUNT (PARTS BY MASS) | TYPE | ADDITION AMOUNT (PARTS BY MASS) |
| 1 | 1 | 210.0 | XDI | 56.0 | CHDM | 34.0 | t-BUTYL ALCOHOL | 3.0 |
| 2 | 8 | 210.0 | XDI | 56.0 | CHDM | 34.0 | t-BUTYL ALCOHOL | 3.0 |
| 3 | 2 | 210.0 | XDI | 56.0 | CHDM | 34.0 | t-BUTYL ALCOHOL | 3.0 |
| 4 | 3 | 210.0 | XDI | 56.0 | CHDM | 34.0 | t-BUTYL ALCOHOL | 3.0 |
| 5 | 1 | 258.0 | XDI | 30.0 | CHDM | 12.0 | t-BUTYL ALCOHOL | 3.0 |
| 6 | 1 | 120.0 | XDI | 106.0 | CHDM | 74.0 | t-BUTYL ALCOHOL | 3.0 |
| 7 | 1 | 210.0 | XDI | 67.5 | PG | 22.5 | t-BUTYL ALCOHOL | 3.0 |
| 8 | 1 | 210.0 | HDI | 40.0 | CHDM | 35.0 | t-BUTYL ALCOHOL | 3.0 |
| | | | IPDI | 15.0 | | | | |
| 9 | 1 | 135.0 | XDI | 97.0 | CHDM | 68.0 | t-BUTYL ALCOHOL | 3.0 |
| 10 | 4 | 210.0 | XDI | 56.0 | CHDM | 34.0 | t-BUTYL ALCOHOL | 3.0 |
| 11 | 5 | 210.0 | XDI | 56.0 | CHDM | 34.0 | t-BUTYL ALCOHOL | 3.0 |
| 12 | 6 | 210.0 | XDI | 56.0 | CHDM | 34.0 | t-BUTYL ALCOHOL | 3.0 |
| 13 | 7 | 210.0 | XDI | 56.0 | CHDM | 34.0 | t-BUTYL ALCOHOL | 3.0 |
| 14 | 1 | 234.0 | XDI | 43.0 | CHDM | 23.0 | t-BUTYL ALCOHOL | 3.0 |
| 15 | 1 | 186.0 | XDI | 69.0 | CHDM | 45.0 | t-BUTYL ALCOHOL | 3.0 |
| 16 | 1 | 210.0 | XDI | 64.0 | PG | 16.0 | t-BUTYL ALCOHOL | 3.0 |
| | | | | | CHDM | 10.0 | | |
| 17 | 1 | 210.0 | HDI | 34.0 | CHDM | 34.0 | t-BUTYL ALCOHOL | 3.0 |
| | | | IPDI | 22.0 | | | | |

TABLE 2-continued

| BLOCK POLYMER No. | SEGMENT CAPABLE OF FORMING CRYSTALLINE STRUCTURE: CRYSTALLINE POLYESTER No. | ADDITION AMOUNT (PARTS BY MASS) | DIISOCYANATE: TYPE | ADDITION AMOUNT (PARTS BY MASS) | ADDITION COMPONENT: TYPE | ADDITION AMOUNT (PARTS BY MASS) | MODIFICATION AGENT: TYPE | ADDITION AMOUNT (PARTS BY MASS) |
|---|---|---|---|---|---|---|---|---|
| 18 | 1 | 210.0 | XDI | 59.0 | PG | 6.0 | t-BUTYL ALCOHOL | 3.0 |
| | | | | | CHDM | 25.0 | | |
| 19 | 1 | 210.0 | HDI | 20.0 | CHDM | 32.0 | t-BUTYL ALCOHOL | 3.0 |
| | | | IPDI | 38.0 | | | | |
| 20 | 1 | 156.0 | XDI | 86.0 | CHDM | 58.0 | t-BUTYL ALCOHOL | 3.0 |
| 21 | 1 | 210.0 | XDI | 58.0 | CHDM | 32.0 | t-BUTYL ALCOHOL | 3.0 |
| 22 | 1 | 210.0 | XDI | 55.0 | CHDM | 35.0 | t-BUTYL ALCOHOL | 3.0 |
| 23 | 1 | 210.0 | XDI | 57.0 | CHDM | 33.0 | t-BUTYL ALCOHOL | 3.0 |
| 24 | 1 | 210.0 | XDI | 55.5 | CHDM | 34.5 | t-BUTYL ALCOHOL | 3.0 |
| 25 | 1 | 195.0 | — | — | AMORPHOUS POLYESTER 1 | 105.0 | — | — |

XDI: XYLYLENE DIISOCYANATE,
HDI: HEXAMETHYLENE DIISOCYANATE,
IPDI: ISOPHORONE DIISOCYANATE,
CHDM: CYCLOHEXANE DIMETHANOL,
PG: PROPYLENE GLYCOL

TABLE 3

| | CONTENT OF CRYSTALLINE POLYESTER (PERCENT BY MASS) | MAXIMUM ENDOTHERMIC PEAK TEMPERATURE (° C.) |
|---|---|---|
| BLOCK POLYMER 1 | 70 | 58 |
| BLOCK POLYMER 2 | 70 | 59 |
| BLOCK POLYMER 3 | 70 | 42 |
| BLOCK POLYMER 4 | 70 | 79 |
| BLOCK POLYMER 5 | 86 | 58 |
| BLOCK POLYMER 6 | 40 | 58 |
| BLOCK POLYMER 7 | 70 | 58 |
| BLOCK POLYMER 8 | 70 | 58 |
| BLOCK POLYMER 9 | 45 | 58 |
| BLOCK POLYMER 10 | 70 | 50 |
| BLOCK POLYMER 11 | 70 | 75 |
| BLOCK POLYMER 12 | 70 | 53 |
| BLOCK POLYMER 13 | 70 | 66 |
| BLOCK POLYMER 14 | 78 | 58 |
| BLOCK POLYMER 15 | 62 | 58 |
| BLOCK POLYMER 16 | 70 | 58 |
| BLOCK POLYMER 17 | 70 | 58 |
| BLOCK POLYMER 18 | 70 | 58 |
| BLOCK POLYMER 19 | 70 | 58 |
| BLOCK POLYMER 20 | 52 | 58 |
| BLOCK POLYMER 21 | 70 | 58 |
| BLOCK POLYMER 22 | 70 | 58 |
| BLOCK POLYMER 23 | 70 | 58 |
| BLOCK POLYMER 24 | 70 | 58 |
| BLOCK POLYMER 25 | 65 | 58 |

<Preparation of Block Polymer Resin Solutions 1 to 25>

In a beaker equipped with a stirring device, 100.0 parts by mass of acetone and 100.0 parts by mass of the block polymer 1 were charged and were stirred at 40° C. until being sufficiently dissolved, so that a block polymer resin solution 1 was prepared. Block polymer resin solutions 2 to 25 were prepared in a manner similar to that described above except that instead of the block polymer 1, the block polymers 2 to 25 were used, respectively.

<Preparation of Amorphous Resin Solution 1>

In a beaker equipped with a stirring device, 100.0 parts by mass of acetone and 100.0 parts by mass of the amorphous resin 2 were charged and were stirred at 40° C. until being sufficiently dissolved, so that an amorphous resin solution 1 was prepared.

<Preparation of Resin Particle Dispersion Liquid 1>

In a two neck flask equipped with a dropping funnel and dried by heating, 870.0 parts by mass of normal hexane was charged. In another beaker, 42.0 parts by mass of normal hexane, 52.0 parts by mass of behenyl acrylate, and 0.3 parts by mass of azobis(methoxy dimethylvaleronitrile) were charged and were mixed by stirring at 20° C. to prepare a monomer solution, and this solution was supplied in the dropping funnel. After a reactor was processed by nitrogen replacement, the monomer solution was dripped at 40° C. over 1 hour under sealing conditions. Stirring was continued for 3 hours after the dripping was completed, a mixture of 0.3 parts by mass of azobis(methoxy dimethylvaleronitrile) and 42.0 parts by mass of normal hexane was dripped again, and stirring was performed at 40° C. for 3 hours. Subsequently, cooling was performed to room temperature, so that a resin particle dispersion liquid 1 having a number average particle diameter of 200 nm and a solid content of 20.0 percent by mass was obtained.

<Preparation of Crystalline Polyester Resin Dispersion Liquid 1>

| | |
|---|---|
| Crystalline polyester 9 | 115.0 parts by mass |
| Ionic surfactant Neogen RK (Dai-Ichi Kogyo Seiyaku Co., Ltd.) | 5.0 parts by mass |
| Ion exchange water | 180.0 parts by mass |

After the above components were mixed together, were heated to 100° C., and were sufficiently dispersed by ULTRA-TURRAX T50 manufactured by IKA, a dispersion treatment was performed by a pressure discharge type gaulin homogenizer for 1 hour, so that a crystalline polyester resin dispersion liquid 1 having a number average particle diameter of 180 nm and a solid content of 40.0 percent by mass was obtained.

<Preparation of Amorphous Resin Dispersion Liquid 1>

| | |
|---|---|
| Amorphous resin 2 | 115.0 parts by mass |
| Ionic surfactant Neogen RK (Dai-Ichi | 5.0 parts by mass |

-continued

| | |
|---|---|
| Kogyo Seiyaku Co., Ltd.) | |
| Ion exchange water | 180.0 parts by mass |

After the above components were mixed together, were heated to 100° C., and were sufficiently dispersed by ULTRA-TURRAX T50 manufactured by IKA, a dispersion treatment was performed by a pressure discharge type gaulin homogenizer for 1 hour, so that an amorphous resin dispersion liquid 1 having a number average particle diameter of 210 nm and a solid content of 40.0 percent by mass was obtained.

<Preparation of Amorphous Resin Dispersion Liquid 2>

| | |
|---|---|
| Amorphous resin 3 | 115.0 parts by mass |
| Ionic surfactant Neogen RK (Dai-Ichi Kogyo Seiyaku Co., Ltd.) | 5.0 parts by mass |
| Ion exchange water | 180.0 parts by mass |

After the above components were mixed together, were heated to 100° C., and were sufficiently dispersed by ULTRA-TURRAX T50 manufactured by IKA, a dispersion treatment was performed by a pressure discharge type gaulin homogenizer for 1 hour, so that an amorphous resin dispersion liquid 2 having a number average particle diameter of 200 nm and a solid content of 40.0 percent by mass was obtained.

<Preparation of Wax Dispersion Liquid 1>

| | |
|---|---|
| Carnauba wax (melting point of 81° C.) | 16.0 parts by mass |
| Nitrile group-containing styrene acrylic resin (styrene/n-butyl acrylate/acrylonitrile = 60.0/30.0/10.0 (mass ratio), peak molecular weight: 8,500) | 8.0 parts by mass |
| Acetone | 76.0 parts by mass |

The above components were charged in a glass beaker (manufactured by IWAKI Glass) equipped with a stirring blade and were heated to 70° C., so that the carnauba wax was dissolved in acetone.

Subsequently, the mixture was gradually cooled to 25° C. over 3 hours while stirring was gently performed at 50 rpm, so that a milky liquid was obtained.

This solution was charge in a heat-resistant container together with 20.0 parts by mass of 1-mm glass beads and was dispersed by a paint shaker (manufactured by TOYO SEIKI SEISAKU-SHO, LTD.) for 3 hours, so that a wax dispersion liquid 1 was obtained.

When the wax particle diameter of the wax dispersion liquid 1 was measured by a microtrack particle size distribution measurement apparatus HRA (X-100) (manufactured by Nikkiso Co., Ltd.), the number average particle diameter was 170 nm. The properties are shown in Table 4.

<Preparation of Wax Dispersion Liquid 2>

| | |
|---|---|
| Paraffin wax (HNP 10, melting point: 75° C., manufactured by NIPPON SEIRO CO., LTD.) | 45.0 parts by mass |
| Ionic surfactant Neogen RK (Dai-Ichi Kogyo Seiyaku Co., Ltd.) | 5.0 parts by mass |
| Ion exchange water | 200.0 parts by mass |

After the above components were mixed together, were heated to 95° C., and were sufficiently dispersed by ULTRA-TURRAX T50 manufactured by IKA, a dispersion treatment was performed by a pressure discharge type gaulin homogenizer, so that a wax dispersion liquid 2 having a number average particle diameter of 200 nm and a solid content of 25.0 percent by mass was obtained.

<Preparation of Colorant Dispersion Liquid 1>

| | |
|---|---|
| C.I. pigment blue 15:3 | 100.0 parts by mass |
| Acetone | 150.0 parts by mass |
| Glass bead (1 mm) | 200.0 parts by mass |

The above materials were charged in a heat-resistant glass container and were dispersed by a paint shaker for 5 hours, and the glass beads were then removed by a nylon mesh, so that a colorant dispersion liquid 1 was obtained.

<Preparation of Colorant Dispersion Liquid 2>

| | |
|---|---|
| C.I. Pigment Blue 15:3 | 45.0 parts by mass |
| Ionic surfactant Neogen RK (Dai-Ichi Kogyo Seiyaku Co., Ltd.) | 5.0 parts by mass |
| Ion exchange water | 200.0 parts by mass |

The above materials were charged in a heat-resistant glass container and were dispersed by a paint shaker for 5 hours, and the glass beads were then removed by a nylon mesh, so that a colorant dispersion liquid 2 was obtained.

<Manufacturing of Carriers>

To magnetite particles having a number average particle diameter of 0.25 μl, 4.0 percent by mass of a silane coupling agent [3-(2-aminoethyl)aminopropyl]trimethoxysilane was added, and high-speed mixing and stirring was carried out at 100° C. or more in a container, so that the magnetite particles were processed by a lipophilic treatment. In a manner similar to that described above, a lipophilic treatment was also performed on a hematite powder having a number average particle diameter of 0.60 μl.

| | |
|---|---|
| Phenol | 10.0 parts by mass |
| Formaldehyde solution (formaldehyde: 40 percent by mass, methanol: 10 percent by mass, water: 50 percent by mass) | 6.0 parts by mass |
| magnetite processed by lipophilic treatment | 63.0 parts by mass |
| hematite processed by lipophilic treatment | 21.0 parts by mass |

The above materials, 5 parts by mass of aqueous ammonia at a concentration of 280, and 10 parts by mass of water were charged in a flask and were heated to 85° C. for 30 minutes and were held while being mixed and stirred, and a polymerization reaction was carried out for 3 hours for curing. Then, after cooling was performed to 30° C., and water was further added, a supernatant was removed, and a precipitate was washed with water and was then dried by air drying. Subsequently, the precipitate thus processed was dried at 60° C. under a reduced pressure of 5 mmHg or less, so that spherical magnetic resin particles were obtained in which a magnetic substance was dispersed.

As a coating resin, a copolymer (copolymerization ratio: 8:1, weight average molecular weight: 45,000) of methyl methacrylate and a methyl methacrylate having a perfluoroalkyl group was used. Next, 10.0 parts by mass of melamine particles having a particle diameter of 290 nm and 6.0 parts by mass of carbon particles having a particle diameter of 30 nm and a specific resistance of $1\times10^{-2}$ Ω.cm were added to 100.0 parts by mass of the coating resin and were dispersed for 30 minutes by an ultrasonic dispersion machine. Furthermore, a mixed solvent coating solution of methyl ethyl ketone and toluene was formed (solution concentration: 10.0 percent by mass) so that the content of the coating resin component was 2.5 parts by mass to 100 parts by mass of carrier cores.

While a shearing stress is continuously applied, resin coating was performed on the surfaces of the magnetic resin particles using this coating solution by vaporizing the solvents at 70° C. The magnetic carrier particles covered with this resin coating were heat-treated at 100° C. for 2 hours while being stirred and were then cooled, pulverized, and sieved using a 200-mesh screen, so that carriers having a number average particle diameter of 33 μl, a true specific gravity of 3.53 g/cm$^3$, an apparent specific gravity of 1.84 g/cm$^3$, and a magnetic intensity of 42 Am$^2$/kg were obtained.

Example 1

(Manufacturing Process of Toner Particles (Before Treatment) 1)

Figure 1:
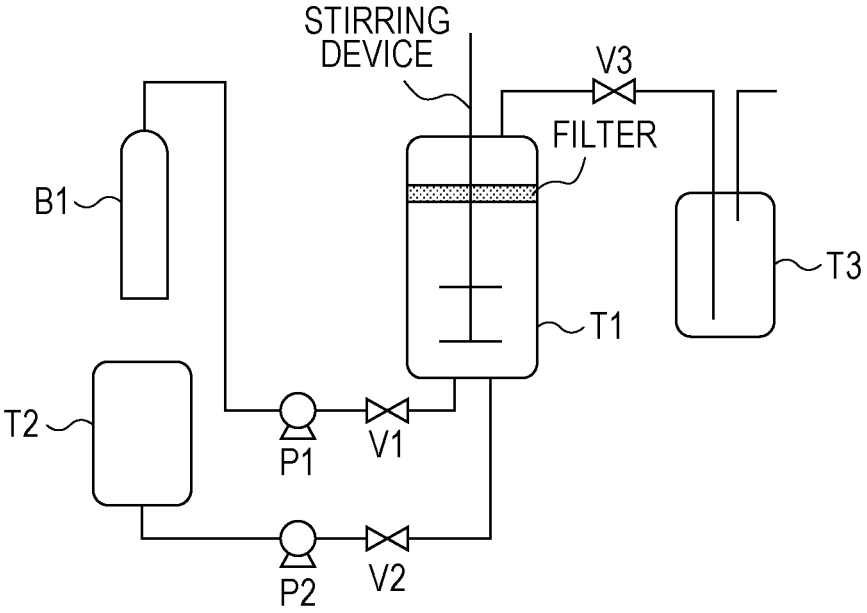
FIG. 1 is a schematic view showing one example of a manufacturing apparatus of a toner according to aspects of the present invention.

In an experimental apparatus shown in FIG. 1, first, valves V1 and V2 and a pressure control valve V3 were closed, the resin particle dispersion liquid 1 was charged in a pressure-resistant granulation tank T1 equipped with a stirring mechanism and a filter for trapping toner particles, and an internal temperature was adjusted to 30° C. Next, the valve V1 was opened to introduce carbon dioxide (purity: 99.990) into the pressure-resistant container T1 from a cylinder B1 using a pump P1, and the valve V1 was then closed when the internal pressure reached 5 MPa.

In addition, the block polymer resin solution 1, the wax dispersion liquid 1, the colorant dispersion liquid 1, and acetone were charged in a resin solution tank T2, and an internal temperature was adjusted to 30° C.

Next, the valve V2 was opened to introduce the content of the resin solution tank T2 into the granulation tank T1 using a pump 2 while the inside thereof was stirred at 2,000 rpm, and the valve 2 was then closed when all the content was introduced.

The internal pressure of the granulation tank T1 reached 8 MPa after the introduction of the content.

The charge amounts (mass ratio) of various types materials were as follows.

| | |
|---|---|
| Block polymer resin solution 1 | 160.0 parts by mass |
| Wax dispersion liquid 1 | 62.5 parts by mass |
| Colorant dispersion liquid 1 | 12.5 parts by mass |
| Acetone | 15.0 parts by mass |
| Resin particle dispersion liquid 1 | 25.0 parts by mass |
| Carbon dioxide | 280.0 parts by mass |

The mass of the carbon dioxide thus introduced was calculated in such a way that the density thereof was calculated from the temperature (30° C.) and the pressure (8 MPa) of carbon dioxide using the equation of state disclosed in the literature (Journal of Physical and Chemical Reference data, vol. 25, pp. 1509-1596) and was then multiplied by the volume of the granulation tank T1.

After the introduction of the content of the resin solution tank T2 into the granulation tank T1 was completed, granulation was further performed by stirring at 2,000 rpm for 3 minutes.

Next, the valve V1 was opened, and carbon dioxide was introduced into the granulation tank T1 from the cylinder B1 using the pump P1. In this step, the pressure control valve V3 was set to 10 MPa, and carbon dioxide was allowed to flow while the internal pressure of the granulation tank T1 was maintained at 10 MPa. By this operation, carbon dioxide containing an organic solvent (primarily acetone) extracted from the liquid droplets after the granulation was discharged to a solvent recovery tank T3, and the organic solvent was separated from carbon dioxide.

The introduction of carbon dioxide into the granulation tank T1 was stopped when the amount thereof reached 5 times the mass of the carbon dioxide which was first introduced into the granulation tank T1. At this stage, an operation in which carbon dioxide containing the organic solvent is replaced with carbon dioxide containing no organic solvent was completed.

Furthermore, the pressure control valve V3 was opened little by little, and the toner particles (before treatment) 1 trapped by the filter were recovered by decreasing the internal pressure of the granulation tank T1 to the atmospheric pressure. The peak temperature of the maximum endothermic peak of the obtained toner particle (before treatment) 1 measured by a DSC measurement was 58° C.

(Annealing Treatment Process)

An annealing treatment was performed using a constant-temperature dry oven (41-S5, manufactured by Satake Chemical Equipment Mfg Ltd.). The internal temperature of the constant-temperature dry oven was adjusted to 51° C.

The toner particles (before treatment) 1 were charged on a tray made from stainless steel to uniformly spread, were placed in the constant-temperature dry oven for 12 hours, and were then recovered. Accordingly, the toner particle (after treatment) 1 processed by the annealing treatment was obtained.

(Preparation of Toner 1 (External Addition Treatment))

Next, 0.9 parts by mass of anatase-type titanium oxide fine powder (BET specific surface area: 80 m$^2$/g, number average particle diameter (D1): 15 nm, processed by isobutyl trimethoxysilane at a concentration of 12 percent by mass) was first externally added to 100.0 parts by mass of the toner particle (after treatment) 1 by a Henschel mixer. Furthermore, 1.2 parts by mass of oil-treated silica particles (BET specific surface area: 95 m$^2$/g, processed by a silicone oil at a concentration of 15 percent by mass) and 1.5 parts by mass of the inorganic particles (sol-gel silica particles; BET specific surface area: 24 m$^2$/g, number average particle diameter (D1): 110 nm) were mixed together by a Henschel mixer FM-10B (trade name, manufactured by Mitsui Miike Machinery Co., Ltd.), so that the toner 1 was obtained.

The properties of the toner 1 are shown in Table 4. In addition, the results of the evaluation performed in accordance with the following procedures are shown in Table 5.

<Heat-Resistant Storage Stability>

Approximately 10 g of the toner 1 was received in a 100-ml polymer cup and was held for 3 days at 50° C. and for 30 days at 50° C., and subsequently, evaluation was performed by visual inspection.

(Evaluation Criteria)

A: No agglomerates are observed, and the conditions of the toner are not substantially changed from the early stage.

B: Although agglomeration occurs very slightly, the agglomerates are destroyed, for example, by lightly shaking the polymer cup 5 times, and no problems arise.

C: Although agglomeration occurs slightly, the agglomerates are easily destroyed when being gently pushed by a finger.

D: Agglomeration considerably occurs.

E: Solidification occurs, and the toner cannot be used.

<Evaluation of Low-Temperature Fixability>

A two component developer of a mixture containing 8.0 parts by mass of the toner 1 and 92.0 parts by mass of the carriers was prepared.

The two component developer and a color copying machine CLC5000 (manufactured by CANON KABUSHIKI KAISHA) were used for the evaluation. The amount of the toner laid on paper was set to 0.6 mg/cm$^2$ by adjusting a development contrast of the copying machine, and a "solid" unfixed image with a leading edge margin of 5 mm, a width of 100 mm, and a length of 280 mm was formed in a single-color mode under an ordinary-temperature, ordinary-humidity environment (23° C./60% RH). As the paper, thick A4 paper ("Plover Bond Paper": 105 g/m$^2$, manufactured by Fox River Paper Company) was used.

Next, a fixing device, LBP5900 (manufactured by CANON KABUSHIKI KAISHA), was modified so that a fixing temperature can be manually set, and the rotational speed and the nip internal pressure of the fixing device were changed to 270 mm/s and 120 kPa, respectively. The fixing temperature under the ordinary-temperature, ordinary-humidity environment (23° C./60%) was increased by every 10° C. from 80° C. to 180° C. using this modified fixing device, and a fixed image of the above "solid" unfixed image at each temperature was obtained.

After soft thin paper (such as trade name "Dasper", manufactured by Ozu Corp.) was placed on an image region of the obtained fixed image, this image region was rubbed reciprocally 5 times through this soft, thin paper with a load of 4.9 kPa. The image densities before and after rubbing were measured, respectively, and a decrease rate ΔD of the image density was calculated by the following formula. A temperature at which this ΔD(%) is less than 10% was defined as a fixing start temperature, and the low-temperature fixability was evaluated by the following evaluation criteria.

In this case, the mage density was measured by a color reflection densitometer X-Rite 404A (manufacturer by X-Rite).

ΔD(%)=(image density before rubbing-image density after rubbing)×100/(image density before rubbing)

When the fixing start temperature was 120° C. or less, it was judged that the toner had excellent low-temperature fixability.

<Evaluation of Fixable Temperature Region>

In the above evaluation of the low-temperature fixability, the paper was changed to regular A4 paper ("office planner": 64 g/m$^2$, manufactured by CANON KABUSHIKI KAISHA), and the fixability was evaluated. From the image after fixing, a temperature at which a high-temperature offset toner of a previous rotation was visually observed at a second rotation of the fixing device was judged as a high-temperature offset start temperature, and the maximum temperature among temperatures lower than the high-temperature offset start temperature was regarded as a high-temperature fixing temperature. In addition, when the high-temperature offset was not generated up to 180° C., 180° C. was regarded as the high-temperature fixing temperature.

The difference between the fixing start temperature of the low-temperature fixability and the high temperature fixing temperature (high temperature fixing temperature-fixing start temperature) was defined as a fixable temperature region, and the following judgment was made. A wider fixable temperature region is more superior.

<Glossiness>

The glossiness of the image was evaluated using the fixed image obtained in the evaluation of the fixable temperature region. The glossiness was measured by a gloss meter manufactured by NIPPON DENSHOKU INDUSTRIES CO., LTD. For the measurement, after a zero adjustment was performed using a standard plate at a light receiving angle of 75° for standard setting, a sample image was placed on 3 pieces of white paper laminated to each other, and the measurement was then performed. A value shown on a display portion was read in the unit of percentage, and the evaluation was performed by the maximum value among the fixed images fixed at the individual temperatures. In this evaluation, a superior glossiness has a higher value.

<Folding Test at Low Temperature>

A "solid" fixed image was formed on transfer paper at a temperature higher than the fixing start temperature by 10° C. After the transfer paper was valley-folded so that an image portion thereon was folded inside, the image region was rubbed reciprocally 5 times with a load of 4.9 kPa applied from the rear side of the image at the folded portion. After the folded transfer paper was unfolded to the original shape and was rotated by 90°, the transfer paper again valley-folded in a direction perpendicular to the folded line previously formed. In addition, the image region was again rubbed reciprocally 5 times with a load of 4.9 kPa applied from the rear side of the image at the folded portion. Furthermore, after the folded transfer paper was again unfolded to the original shape, soft, thin paper (trade name "Dasper", manufactured by Ozu Corp.) was placed on an intersection of the image region formed by folding twice, and the image region was rubbed reciprocally 5 times with a load of 4.9 kPa applied through the above thin paper.

(Evaluation Criteria)

A: No peeling is observed at the intersection, and no discoloration is also observed.

B: Although no peeling occurs at the intersection, slight discoloration occurs.

C: Slight peeling is generated at the intersection, and an underlayer portion of the paper is observed.

D: An underlayer portion of the paper is observed not only at the intersection but also at the folded portion.

E: A rubbed portion at the folded portion is totally peeled off.

Comparative Example 1

(Process for Manufacturing Toner Particle 2)

| | |
|---|---|
| Crystalline polyester resin dispersion liquid 1 | 42.5 parts by mass |
| Amorphous resin dispersion liquid 1 | 170.0 parts by mass |
| Colorant dispersion liquid 2 | 25.0 parts by mass |
| Wax dispersion liquid 2 | 40.0 parts by mass |
| Polyaluminum chloride | 0.41 parts by mass |

The above components were charged in a round stainless steel-made flask and sufficiently mixed and dispersed by ULTRA-TURRAX T50. Subsequently, 0.36 parts by mass of polyaluminum chloride was added to the above mixture, and a dispersing operation was continued by ULTRA-TURRAX T50. After the flask was heated to 47° C. using an oil bath for heating while stirring was performed, and this temperature was held for 60 minutes, 31.0 parts by mass of the resin particle dispersion liquid 1 was gently added in the flask. Then, after the pH in the flask was controlled to 5.4 with an aqueous sodium hydroxide solution at a concentration of 0.5 mol/L, and the stainless steel-made flask was sealed, the temperature was increased to 96° C. and was maintained for 5 hours while stirring was continued using a magnetic seal.

After the reaction was completed, and cooling, filtration, and sufficient washing with ion exchange water were performed, solid liquid separation was performed by nutsche type suction filtration. The solid component was again dispersed in 3 liters of ion exchange water at 40° C., and stirring and washing were performed at 300 rpm for 15 minutes. This step was further repeated 5 times, and when the filtrate had a pH of 7.0, by nutsche type suction filtration, solid liquid separation was performed using No. 5A filter paper. Subsequently, vacuum drying was continued for 12 hours, so that toner particles 2 were obtained. The peak temperature of the maximum endothermic peak of the toner particles 2 by a DSC measurement was 50° C.

(Process for Manufacturing Toner 2)

Next, the toner particles 2 were processed by an external addition treatment similar to that of Example 1 without performing an annealing step, so that a toner 2 was obtained. The properties of the toner 2 are shown in Table 4, and the results of the evaluations performed as in Example 1 are shown in Table 5.

Comparative Example 2

The toner particles 2 were processed by an annealing treatment similar to that of Example 1 except that the annealing temperature was changed to 43° C., so that toner particles 3 were obtained. An external addition treatment was performed on the obtained particles as in Example 1, and a toner 3 was obtained. The properties of the toner 3 are shown in Table 4, and the results of the evaluations performed as in Example 1 are shown in Table 5.

Comparative Example 3

The amounts of the dispersion liquids used for the manufacturing process of the toner particles 2 were changed as follows, and toner particles (before treatment) 4 were formed.

| | |
|---|---|
| Crystalline polyester resin dispersion liquid 1 | 150.0 parts by mass |
| Amorphous resin dispersion liquid 2 | 64.0 parts by mass |
| Colorant dispersion liquid 2 | 25.0 parts by mass |
| Wax dispersion liquid 2 | 40.0 parts by mass |
| Polyaluminum chloride | 0.41 parts by mass |

The peak temperature of the maximum endothermic peak of the obtained toner particles (before treatment) 4 by a DSC measurement was 58° C. Toner particles (after treatment) 4 were obtained by performing an annealing treatment similar to that of Example 1, and an external addition treatment was performed as in Example 1, so that a toner 4 was obtained. The properties of the toner 4 are shown in Table 4, and the results of the evaluations performed as in Example 1 are shown in Table 5.

Comparative Example 4

The block polymer resin solution 1 in the process for manufacturing the toner particles (before treatment) 1 of Example 1 was changed to the block polymer resin solution 25, and toner particles (before treatment) 5 were obtained. The peak temperature of the maximum endothermic peak of the obtained toner particles (before treatment) 5 by a DSC measurement was 58° C. Toner particles (after treatment) 5 were obtained by performing an annealing treatment similar to that of Example 1. An external addition treatment similar to that of Example 1 was performed using the obtained particles, so that a toner 5 was obtained. The properties of the toner 5 are shown in Table 4, and the results of the evaluations performed as in Example 1 are shown in Table 5.

Comparative Example 5

The block polymer resin solution 1 in the process for manufacturing the toner particles (before treatment) 1 of Example 1 was changed to the block polymer resin solution 2, and toner particles (before treatment) 6 were obtained. The peak temperature of the maximum endothermic peak of the obtained toner particles (before treatment) 6 by a DSC measurement was 59° C. An external addition treatment similar to that of Example 1 was performed on the toner particles (before treatment) 6 without performing an annealing step, so that a toner 6 was obtained. The properties of the toner 6 are shown in Table 4, and the results of the evaluations performed as in Example 1 are shown in Table 5.

Reference Examples 1 and 2

The block polymer resin solution 1 in the process for manufacturing the toner particles (before treatment) 1 of Example 1 was changed to the block polymer resin solutions 3 and 4, and toner particles (before treatment) 1 and 8 were obtained. The peak temperatures of the maximum endothermic peaks of the obtained toner particles (before treatment) 7 and 8 by a DSC measurement were 42° C. and 79° C., respectively. An annealing treatment similar to that of Example 1 was performed using the obtained toner particles (before treatment) 7 and 8 except that the annealing temperatures were changed to 35° C. and 72° C., respectively. An external addition treatment similar to that of Example 1 was performed on the obtained toner particles, so that toners 7 and 8 were obtained. The properties of the toners 7 and 8 are shown in Table 4, and the results of the evaluations performed as in Example 1 are shown in Table 5.

Reference Examples 3 and 4

The block polymer resin solution 1 in the process for manufacturing the toner particles (before treatment) 1 of Example 1 was changed to the block polymer resin solutions 5 and 6, and toner particles (before treatment) 9 and 10 were obtained. The peak temperatures of the maximum endothermic peaks of the obtained toner particles (before treatment) 9 and 10 by a DSC measurement were both 58° C. An annealing treatment similar to that of Example 1 was performed using the obtained toner particles (before treatment) 9 and 10. An external addition treatment was performed as in Example 1 on the obtained toner particles, so that toners 9 and 10 were obtained. The properties of the toners 9 and 10 are shown in Table 4, and the results of the evaluations performed as in Example 1 are shown in Table 5.

Reference Examples 5 to 7

The block polymer resin solution 1 in the process for manufacturing the toner particles (before treatment) 1 of Example 1 was changed to the block polymer resin solutions 7 to 9, and toner particles (before treatment) 11 to 13 were obtained. The peak temperatures of the maximum endothermic peaks of the obtained toner particles (before treatment) 11 to 13 by a DSC measurement were each 58° C. An annealing treatment similar to that of Example 1 was performed using the obtained toner particles (before treatment) 11 to 13. An external addition treatment was performed as in Example 1 on the obtained toner particles, so that toners 11 to 13 were obtained. The properties of the toners 11 to 13 are shown in Table 4, and the results of the evaluations performed as in Example 1 are shown in Table 5.

Examples 2 to 5

The block polymer resin solution 1 in the process for manufacturing the toner particles (before treatment) 1 of Example 1 was changed to the block polymer resin solutions 10 to 13, and toner particles (before treatment) 14 to 17 were obtained. The peak temperatures of the maximum endothermic peaks of the obtained toner particles (before treatment) 14 to 17 by a DSC measurement were 50° C., 75° C., 53° C., and 66° C., respectively. An annealing treatment similar to that of Example 1 was performed except that the annealing temperature was changed to 43° C., 68° C., 46° C., and 59° C., respectively. An external addition treatment was performed as in Example 1 on the obtained toner particles, so that toners 14 to 17 were obtained. The properties of the toners 14 to 17 are shown in Table 4, and the results of the evaluations performed as in Example 1 are shown in Table 5.

Examples 6 and 7

The block polymer resin solution 1 in the process for manufacturing the toner particles (before treatment) 1 of Example 1 was changed to the block polymer resin solutions 14 and 15, and toner particles (before treatment) 18 and 19 were obtained. The peak temperatures of the maximum endothermic peaks of the obtained toner particles (before treatment) 18 and 19 by a DSC measurement were both 58° C. An annealing treatment and an external addition treatment similar to those of Example 1 were performed, so that toners 18 and 19 were obtained. The properties of the toners 18 and 19 are shown in Table 4, and the results of the evaluations are shown in Table 5.

Example 8

Instead of using the block polymer resin solution 1 in the process for manufacturing the toner particles (before treatment) 1 of Example 1, 152.0 parts by mass of the block polymer resin solution 2 and 8.0 parts by mass of the amorphous resin solution 1 were used, so that toner particles (before treatment) 20 was obtained. The peak temperature of the maximum endothermic peak of the obtained toner particles (before treatment) 20 by a DSC measurement was 59° C. An annealing treatment similar to that of Example 1 was performed except that the annealing temperature was changed to 52° C. An external addition treatment was performed as in Example 1 on the obtained toner particles, so that a toner 20 was obtained. The properties of the toner 20 are shown in Table 4, and the results of the evaluations performed as in Example 1 are shown in Table 5.

Example 9

An annealing treatment similar to that of Example 1 was performed using the toner particles (before treatment) 6 of Comparative Example 5 except that the annealing temperature was changed to 49° C., and the treatment time was changed to 2 hours. An external addition treatment was performed as in Example 1 on the obtained toner particles, so that a toner 21 was obtained. The properties of the toner 21 are shown in Table 4, and the results of the evaluations performed as in Example 1 are shown in Table 5.

Example 10

Except that the annealing temperature was changed to 52° C., and the treatment time was changed to 50 hours, a toner 22 was obtained in a manner similar to that of Example 9. The properties of the toner 22 are shown in Table 4, and the results of the evaluations performed as in Example 1 are shown in Table 5.

Example 11

Except that the annealing temperature was changed to 52° C., and the treatment time was changed to 2 hours, a toner 23 was obtained in a manner similar to that of Example 9. The properties of the toner 23 are shown in Table 4, and the results of the evaluations performed as in Example 1 are shown in Table 5.

Examples 12 to 20

The block polymer resin solution 1 in the process for manufacturing the toner particles (before treatment) 1 of Example 1 was changed to the block polymer resin solutions 16 to 24, and toner particles (before treatment) 24 to 32 were obtained. The peak temperatures of the maximum endothermic peaks of the obtained toner particles (before treatment) 24 to 32 by a DSC measurement were each 58° C. An annealing treatment was performed similar to that of Example 1, and an external addition treatment was performed as in Example 1, so that toners 24 to 32 were obtained. The properties of the toners 24 to 32 are shown in Table 4, and the results of the evaluations performed as in Example 1 are shown in Table 5.

TABLE 4

| | TONER | Tp | G"(Tp − 10) (Pa) | G"(Tp + 10) (Pa) | FORMULA (1) | FORMULA (2) | FORMULA (3) | WEIGHT AVERAGE PARTICLE DIAMETER (μm) | D4/D1 | NUMBER AVERAGE MOLECULAR WEIGHT (Mn) | WEIGHT AVERAGE MOLECULAR WEIGHT (Mw) |
|---|---|---|---|---|---|---|---|---|---|---|---|
| EXAMPLE 1 | TONER 1 | 61 | $1.1 \times 10^8$ | $1.4 \times 10^6$ | 0.10 | 0.24 | 1.52 | 5.8 | 1.14 | 15,700 | 33,500 |
| EXAMPLE 2 | TONER 14 | 53 | $9.2 \times 10^7$ | $1.3 \times 10^6$ | 0.12 | 0.22 | 1.48 | 5.8 | 1.16 | 14,300 | 30,800 |
| EXAMPLE 3 | TONER 15 | 78 | $1.4 \times 10^8$ | $1.5 \times 10^6$ | 0.11 | 0.23 | 1.51 | 5.8 | 1.15 | 15,600 | 34,900 |
| EXAMPLE 4 | TONER 16 | 56 | $9.8 \times 10^7$ | $1.3 \times 10^6$ | 0.13 | 0.25 | 1.53 | 5.8 | 1.16 | 15,100 | 32,800 |
| EXAMPLE 5 | TONER 17 | 69 | $1.2 \times 10^8$ | $1.4 \times 10^6$ | 0.10 | 0.21 | 1.51 | 5.8 | 1.15 | 15,800 | 30,800 |
| EXAMPLE 6 | TONER 18 | 61 | $1.0 \times 10^8$ | $5.6 \times 10^6$ | 0.12 | 0.22 | 1.78 | 5.8 | 1.18 | 13,900 | 30,700 |
| EXAMPLE 7 | TONER 19 | 61 | $1.3 \times 10^8$ | $3.6 \times 10^6$ | 0.11 | 0.22 | 1.23 | 5.8 | 1.16 | 18,000 | 39,300 |
| EXAMPLE 8 | TONER 20 | 61 | $1.2 \times 10^8$ | $1.2 \times 10^6$ | −0.08 | 0.21 | 1.73 | 5.8 | 1.15 | 14,700 | 34,400 |
| EXAMPLE 9 | TONER 21 | 60 | $1.3 \times 10^8$ | $1.1 \times 10^6$ | 0.47 | 0.22 | 1.22 | 5.8 | 1.18 | 15,000 | 33,900 |
| EXAMPLE 10 | TONER 22 | 62 | $1.1 \times 10^8$ | $1.0 \times 10^6$ | 0.02 | 0.21 | 1.51 | 5.8 | 1.17 | 15,100 | 33,900 |
| EXAMPLE 11 | TONER 23 | 60 | $1.1 \times 10^8$ | $1.3 \times 10^6$ | 0.28 | 0.21 | 1.41 | 5.8 | 1.16 | 15,100 | 34,000 |
| EXAMPLE 12 | TONER 24 | 61 | $1.0 \times 10^8$ | $1.4 \times 10^6$ | 0.13 | 0.12 | 1.52 | 5.8 | 1.17 | 16,800 | 35,300 |
| EXAMPLE 13 | TONER 25 | 61 | $1.2 \times 10^8$ | $1.7 \times 10^6$ | 0.11 | 0.99 | 1.51 | 5.8 | 1.18 | 13,100 | 30,200 |
| EXAMPLE 14 | TONER 26 | 61 | $1.3 \times 10^8$ | $1.5 \times 10^6$ | 0.13 | 0.20 | 1.57 | 5.8 | 1.17 | 16,200 | 35,200 |
| EXAMPLE 15 | TONER 27 | 61 | $1.1 \times 10^8$ | $1.4 \times 10^6$ | 0.13 | 0.78 | 1.49 | 5.8 | 1.15 | 11,800 | 28,100 |
| EXAMPLE 16 | TONER 28 | 61 | $1.1 \times 10^8$ | $4.2 \times 10^6$ | 0.13 | 0.20 | 1.10 | 5.8 | 1.16 | 13,000 | 29,100 |

TABLE 4-continued

| | TONER | Tp | G"(Tp − 10) (Pa) | G"(Tp + 10) (Pa) | FORMULA (1) | FORMULA (2) | FORMULA (3) | WEIGHT AVERAGE PARTICLE DIAMETER (μm) | D4/D1 | NUMBER AVERAGE MOLECULAR WEIGHT (Mn) | WEIGHT AVERAGE MOLECULAR WEIGHT (Mw) |
|---|---|---|---|---|---|---|---|---|---|---|---|
| EXAMPLE 17 | TONER 29 | 61 | $6.2 \times 10^7$ | $5.4 \times 10^6$ | 0.12 | 0.22 | 1.73 | 5.8 | 1.17 | 6,800 | 14,800 |
| EXAMPLE 18 | TONER 30 | 61 | $3.1 \times 10^8$ | $4.8 \times 10^6$ | 0.11 | 0.23 | 1.02 | 6.2 | 1.26 | 39,600 | 73,500 |
| EXAMPLE 19 | TONER 31 | 61 | $8.0 \times 10^7$ | $7.2 \times 10^6$ | 0.12 | 0.22 | 1.63 | 5.8 | 1.17 | 9,500 | 19,600 |
| EXAMPLE 20 | TONER 32 | 61 | $2.4 \times 10^8$ | $2.8 \times 10^6$ | 0.12 | 0.20 | 1.42 | 5.8 | 1.19 | 27,900 | 57,900 |
| COMPARATIVE EXAMPLE 1 | TONER 2 | 50 | $1.1 \times 10^8$ | $3.7 \times 10^6$ | 0.70 | 0.20 | 1.12 | 5.8 | 1.18 | 8,100 | 46,700 |
| COMPARATIVE EXAMPLE 2 | TONER 3 | 53 | $1.2 \times 10^8$ | $3.9 \times 10^6$ | −0.20 | 0.21 | 1.15 | 5.8 | 1.17 | 8,100 | 46,700 |
| COMPARATIVE EXAMPLE 3 | TONER 4 | 61 | $1.0 \times 10^8$ | NOT MEASURABLE | 0.10 | NOT MEASURABLE | 1.97 | 5.8 | 1.17 | 9,700 | 46,600 |
| COMPARATIVE EXAMPLE 4 | TONER 5 | 61 | $1.4 \times 10^8$ | NOT MEASURABLE | 0.13 | NOT MEASURABLE | 1.82 | 5.8 | 1.14 | 19,600 | 74,900 |
| COMPARATIVE EXAMPLE 5 | TONER 6 | 59 | $9.8 \times 10^7$ | $1.0 \times 10^6$ | 0.63 | 0.21 | 1.04 | 5.8 | 1.16 | 15,100 | 33,900 |
| REFERENCE EXAMPLE 1 | TONER 7 | 45 | $8.7 \times 10^7$ | $1.2 \times 10^6$ | 0.11 | 0.24 | 1.50 | 5.8 | 1.16 | 15,200 | 34,300 |
| REFERENCE EXAMPLE 2 | TONER 8 | 82 | $1.6 \times 10^8$ | $1.5 \times 10^6$ | 0.13 | 0.20 | 1.63 | 5.8 | 1.18 | 15,000 | 32,800 |
| REFERENCE EXAMPLE 3 | TONER 9 | 61 | $1.0 \times 10^8$ | $2.3 \times 10^6$ | 0.12 | 0.22 | 1.83 | 5.8 | 1.15 | 12,600 | 28,200 |
| REFERENCE EXAMPLE 4 | TONER 10 | 61 | $1.4 \times 10^8$ | $8.6 \times 10^6$ | 0.10 | 0.23 | 0.94 | 5.8 | 1.16 | 11,700 | 23,500 |
| REFERENCE EXAMPLE 5 | TONER 11 | 61 | $1.2 \times 10^8$ | $2.1 \times 10^6$ | 0.12 | 0.05 | 1.42 | 5.8 | 1.15 | 14,700 | 30,300 |
| REFERENCE EXAMPLE 6 | TONER 12 | 61 | $1.3 \times 10^8$ | $9.3 \times 10^6$ | 0.11 | 1.20 | 1.73 | 5.8 | 1.16 | 15,100 | 31,200 |
| REFERENCE EXAMPLE 7 | TONER 13 | 61 | $9.7 \times 10^7$ | $4.7 \times 10^6$ | 0.11 | 0.21 | 0.80 | 5.8 | 1.18 | 18,300 | 41,400 |

FORMULA (1) = Log[G"(Tp − 20)] − Log[G"(Tp − 10)]
FORMULA (2) = Log[G"(Tp + 10)] − Log[G"(Tp + 30)]
FORMULA (3) = Log[G"(Tp − 5)] − Log[G"(Tp + 5)]

TABLE 5

| | TONER | HEAT-RESISTANT STORAGE STABILITY 3 DAYS | HEAT-RESISTANT STORAGE STABILITY 30 DAYS | FIXING START TEMPERATURE (° C.) | FIXABLE TEMPERATURE REGION (° C.) | GLOSSINESS | FOLDING TEST AT LOW TEMPERATURE |
|---|---|---|---|---|---|---|---|
| EXAMPLE 1 | TONER 1 | A | A | 100 | 80 | 35.3 | A |
| EXAMPLE 2 | TONER 14 | B | C | 100 | 80 | 34.1 | A |
| EXAMPLE 3 | TONER 15 | A | A | 120 | 60 | 34.2 | B |
| EXAMPLE 4 | TONER 16 | A | B | 100 | 80 | 33.8 | A |
| EXAMPLE 5 | TONER 17 | A | A | 110 | 70 | 35.1 | A |
| EXAMPLE 6 | TONER 18 | A | A | 100 | 50 | 28.6 | A |
| EXAMPLE 7 | TONER 19 | A | A | 100 | 80 | 35.4 | C |
| EXAMPLE 8 | TONER 20 | A | A | 110 | 70 | 33.8 | B |
| EXAMPLE 9 | TONER 21 | B | C | 100 | 80 | 34.3 | A |
| EXAMPLE 10 | TONER 22 | A | A | 100 | 80 | 34.0 | A |
| EXAMPLE 11 | TONER 23 | A | B | 100 | 80 | 33.8 | A |
| EXAMPLE 12 | TONER 24 | A | A | 100 | 80 | 25.6 | B |
| EXAMPLE 13 | TONER 25 | A | A | 100 | 50 | 34.2 | A |
| EXAMPLE 14 | TONER 26 | A | A | 100 | 80 | 29.6 | A |
| EXAMPLE 15 | TONER 27 | A | A | 100 | 60 | 34.3 | A |
| EXAMPLE 16 | TONER 28 | A | A | 120 | 60 | 30.1 | C |
| EXAMPLE 17 | TONER 29 | A | C | 100 | 50 | 34.2 | A |
| EXAMPLE 18 | TONER 30 | A | A | 120 | 60 | 34.3 | C |
| EXAMPLE 19 | TONER 31 | A | B | 100 | 70 | 34.8 | A |
| EXAMPLE 20 | TONER 32 | A | A | 110 | 70 | 34.1 | B |
| COMPARATIVE EXAMPLE 1 | TONER 2 | E | E | 130 | 50 | 33.7 | D |
| COMPARATIVE EXAMPLE 2 | TONER 3 | B | C | 140 | 40 | 33.8 | E |
| COMPARATIVE EXAMPLE 3 | TONER 4 | A | A | 100 | 20 | 24.6 | C |
| COMPARATIVE EXAMPLE 4 | TONER 5 | A | A | 110 | 30 | 28.7 | B |
| COMPARATIVE EXAMPLE 5 | TONER 6 | D | E | 120 | 60 | 34.2 | A |
| REFERENCE EXAMPLE 1 | TONER 7 | D | E | 90 | 70 | 33.6 | A |
| REFERENCE EXAMPLE 2 | TONER 8 | A | A | 130 | 50 | 33.4 | C |
| REFERENCE EXAMPLE 3 | TONER 9 | A | A | 100 | 40 | 28.4 | B |
| REFERENCE EXAMPLE 4 | TONER 10 | A | A | 130 | 50 | 27.1 | D |

TABLE 5-continued

| | TONER | HEAT-RESISTANT STORAGE STABILITY 3 DAYS | HEAT-RESISTANT STORAGE STABILITY 30 DAYS | FIXING START TEMPERATURE (° C.) | FIXABLE TEMPER-ATURE REGION (° C.) | GLOSSINESS | FOLDING TEST AT LOW TEMPERATURE |
|---|---|---|---|---|---|---|---|
| REFERENCE EXAMPLE 5 | TONER 11 | A | A | 100 | 80 | 21.3 | B |
| REFERENCE EXAMPLE 6 | TONER 12 | A | A | 100 | 30 | 31.4 | B |
| REFERENCE EXAMPLE 7 | TONER 13 | A | A | 130 | 50 | 24.3 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-165308 filed Jul. 22, 2010, which is hereby incorporated by reference herein in its entirety.

What is claimed is:

1. A toner comprising toner particles, each of which comprises a colorant, a wax, and a binder resin, wherein the binder resin comprises a resin (a) mainly composed of a polyester unit, the resin (a) being a crystalline resin, wherein in measuring endothermic amount of the toner by a differential scanning calorimeter, an endothermic peak temperature (Tp) derived from the binder resin is in a range of 55° C. to 70° C., and wherein in measuring viscoelasticity of the toner, when a loss modulus G"[Pa] at a temperature T[° C.] is represented by G" (T), G"(Tp−10) is in a range of $5.0\times10^7$ to $5.0\times10^8$ Pa, G"(Tp+10) is in a range of $5.0\times10^5$ to $5.0\times10^6$ Pa, and the loss modulus G"[Pa] satisfies the following formulas (1) to (3):

$$-0.10 \leq \mathrm{Log}\,[G''(Tp-20)] - \mathrm{Log}\,[G''(Tp-10)] \leq 0.28 \quad (1)$$

$$0.10 \leq \mathrm{Log}\,[G''(Tp+10)] - \mathrm{Log}\,[G''(Tp+30)] \leq 1.00 \quad (2)$$

$$\mathrm{Log}\,[G''(Tp-5)] - \mathrm{Log}\,[G''(Tp+5)] \geq 1.0 \quad (3),$$

wherein the resin (a) is a block-polymer having a crystalline portion of a polyester resin and an amorphous portion of a polyurethane resin, the ratio of the unit forming the crystalline portion to the resin (a) is in a range of 50 to 90 percent by mass, and the content of the resin (a) in the binder resin in 70 percent by mass or more, and wherein a tetrahydrofuran (THF) soluble component of the toner has the number average molecular weight (Mn) of 8,000 to 30,000 and has the weight average molecular weight (Mw) of 15,000 to 60,000, both of which are measured by a gel permeation chromatography (GPC) and wherein the toner particles have been annealed in a temperature range from a first temperature to a second temperature for 5 to 24 hours, wherein the first temperature is obtained by subtracting 10° C. from a peak temperature of the endothermic peak derived from the crystalline portion of the block-polymer in before-annealed toner particles, the second temperature is obtained by subtracting 5° C. from the peak temperature, and the peak temperature is obtained by a DSC measurement of the before-annealed toner particles performed at a temperature rise rate of 10.0° C./min.

* * * * *